US011050150B2

(12) United States Patent
Kim et al.

(10) Patent No.: US 11,050,150 B2
(45) Date of Patent: Jun. 29, 2021

(54) ANTENNA APPARATUS AND ANTENNA MODULE

(71) Applicant: Samsung Electro-Mechanics Co., Ltd., Suwon-si (KR)

(72) Inventors: Nam Ki Kim, Suwon-si (KR); Jeong Ki Ryoo, Suwon-si (KR); Sang Hyun Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 110 days.

(21) Appl. No.: 16/171,844

(22) Filed: Oct. 26, 2018

(65) Prior Publication Data

US 2019/0173176 A1 Jun. 6, 2019

(30) Foreign Application Priority Data

Dec. 1, 2017 (KR) ..... 10-2017-0164105
Jun. 4, 2018 (KR) ..... 10-2018-0064244

(51) Int. Cl.
*H01Q 1/22* (2006.01)
*H01Q 5/371* (2015.01)
(Continued)

(52) U.S. Cl.
CPC ..... *H01Q 5/371* (2015.01); *H01Q 5/49* (2015.01); *H01Q 9/16* (2013.01); *H01Q 9/26* (2013.01);
(Continued)

(58) Field of Classification Search
CPC ..... H01C 5/371; H01C 5/49; H01Q 21/065; H01Q 21/062; H01Q 21/29; H01Q 21/28;
(Continued)

(56) References Cited

U.S. PATENT DOCUMENTS

2011/0285474 A1 11/2011 Ali
2012/0229343 A1* 9/2012 Sudo ..... H01Q 19/28 343/700 MS
(Continued)

FOREIGN PATENT DOCUMENTS

CN 101064379 A 10/2007
CN 101443957 A 5/2009
(Continued)

OTHER PUBLICATIONS

The ARRL Antenna Book by The American Radio Relay League. (Year: 1988).*
(Continued)

*Primary Examiner* — Awat M Salih
(74) *Attorney, Agent, or Firm* — NSIP Law

(57) ABSTRACT

An antenna apparatus includes: a first ground layer; a second ground layer disposed on a surface of the first ground layer; an antenna pattern spaced apart from the first and second ground layers in a direction of the surface, and configured to transmit and/or receive a radio frequency (RF) signal; and a feed line electrically connected to the antenna pattern and extending from the antenna pattern toward the first ground layer in the direction of the surface, wherein the first ground layer includes a first region recessed, relative to the second ground layer, in the direction of the surface.

15 Claims, 19 Drawing Sheets

(51) Int. Cl.

| | |
|---|---|
| ***H01Q 11/14*** | (2006.01) |
| ***H01Q 5/49*** | (2015.01) |
| ***H01Q 13/18*** | (2006.01) |
| ***H01Q 21/06*** | (2006.01) |
| ***H01Q 21/29*** | (2006.01) |
| ***H01Q 9/26*** | (2006.01) |
| ***H01Q 19/24*** | (2006.01) |
| ***H01Q 9/16*** | (2006.01) |
| ***H01Q 21/28*** | (2006.01) |
| *H01Q 1/52* | (2006.01) |
| *H01Q 1/24* | (2006.01) |
| *H01Q 19/10* | (2006.01) |

(52) U.S. Cl.
CPC ..... *H01Q 11/14* (2013.01); *H01Q 13/18* (2013.01); *H01Q 19/24* (2013.01); *H01Q 21/062* (2013.01); *H01Q 21/065* (2013.01); *H01Q 21/28* (2013.01); *H01Q 21/29* (2013.01); *H01Q 1/2283* (2013.01); *H01Q 1/243* (2013.01); *H01Q 1/52* (2013.01); *H01Q 1/526* (2013.01); *H01Q 19/106* (2013.01)

(58) Field of Classification Search
CPC ..... H01Q 9/26; H01Q 9/16; H01Q 19/24; H01Q 19/106; H01Q 11/14; H01Q 5/49; H01Q 13/18; H01Q 1/52; H01Q 1/243; H01Q 1/2283; H01Q 1/526
See application file for complete search history.

(56) References Cited

U.S. PATENT DOCUMENTS

| | | | | |
|---|---|---|---|---|
| 2013/0069837 | A1* | 3/2013 | Cozzolino ..... | H01Q 13/10 343/727 |
| 2015/0002363 | A1 | 1/2015 | Wong et al. | |
| 2016/0294052 | A1 | 10/2016 | Baek et al. | |
| 2017/0214119 | A1 | 7/2017 | Aoki | |
| 2017/0309991 | A1 | 10/2017 | Noori et al. | |

FOREIGN PATENT DOCUMENTS

| | | | |
|---|---|---|---|
| CN | 102683835 | A | 9/2012 |
| CN | 102906936 | A | 1/2013 |
| CN | 103563166 | A | 2/2014 |
| CN | 106992357 | A | 7/2017 |
| JP | 2001-313516 | A | 11/2001 |
| JP | 2010-114645 | A | 5/2010 |
| JP | 2013-534079 | A | 8/2013 |
| JP | 2017-130832 | A | 7/2017 |
| JP | 3211380 | U | 7/2017 |
| KR | 10-2013-0080776 | A | 7/2013 |
| KR | 10-2013-0141680 | A | 12/2013 |
| KR | 10-2015-0033187 | A | 4/2015 |
| KR | 10-2015-0130046 | A | 11/2015 |
| KR | 10-1791436 | B1 | 11/2017 |
| WO | WO 2007/126897 | A2 | 11/2007 |
| WO | WO 2011/149941 | A1 | 12/2011 |
| WO | WO 2012/129426 | A2 | 9/2012 |

OTHER PUBLICATIONS

Korean Office Action dated Mar. 26, 2019 in counterpart Korean Patent Application No. 10-2018-0064244 (6 pages in English and 5 pages in Korean).
Chinese Office Action dated Apr. 2, 2020 issued in the corresponding Chinese Patent Application No. 201811453588.0. (24 pages in English, 17 pages in Chinese).
Chinese Office Action dated Mar. 16, 2020 in corresponding Chinese Patent Application No. 201811452713.6 (24 pages in English, 17 pages in Chinese).
Japanese Office Action dated Oct. 15, 2019 in counterpart Japanese Patent Application No. 2018-206866 (4 pages in English and 3 pages in Japanese).

* cited by examiner

ANTENNA APPARATUS AND ANTENNA MODULE

CROSS-REFERENCE TO RELATED APPLICATIONS

This application claims the benefit under 35 U.S.C. § 119(a) of Korean Patent Application Nos. 10-2017-0164105 and 10-2018-0064244 filed on Dec. 1, 2017 and Jun. 4, 2018, respectively, in the Korean Intellectual Property Office, the entire disclosures of which are incorporated herein by reference for all purposes.

BACKGROUND

1. Field

The following description relates to an antenna apparatus and an antenna module.

2. Description of Related Art

Mobile communications data traffic tends to increase rapidly every year. Technological development is being pursued to support rapidly increasing data in wireless networks in real time. For example, applications such as generating content from Internet of thing (IoT)-based data, augmented reality (AR), virtual reality (VR), live VR/AR combined with social network services (SNS), autonomous driving, sync view (real-time image transmission of a user's view using compact camera), and the like, require communications (e.g., $5^{th}$-generation (5G) communications, millimeter wave (mmWave) communications, etc.) supporting the exchange of mass data.

Therefore, mmWave communications including 5G communications have been studied and researched with regard to the commercialization/standardization of antenna modules capable of smoothly implementing mmWave communications.

RF signals in high frequency bands (e.g., 24 GHz, 28 GHz, 36 GHz, 39 GHz, 60 GHz, etc.) are easily absorbed in the course of transmissions and lead to loss, so that quality of communications may be drastically lowered. Therefore, antennas for communications of high-frequency bands may demand a technical approach different from that of the related art antenna technology, and the development of special technologies such as a separate power amplifier for securing an antenna gain, integrating an antenna and a radio frequency integrated circuit (RFIC), and ensuring effective isotropic radiated power, for example, may be beneficial.

Traditionally, antenna modules providing a mmWave communications environment include a structure in which an integrated circuit (IC) and an antenna are disposed on a board and are connected by a coaxial cable to meet a high level (e.g., transmit/receive ratio, gain, directivity, etc.) of antenna performance according to high frequencies. This structure, however, may lead to insufficient antenna layout space, limitations on the degree of freedom of an antenna shape, increased interference between the antenna and the IC, and an increase in the size and/or cost of antenna modules.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes: a first ground layer; a second ground layer disposed on a surface of the first ground layer; an antenna pattern spaced apart from the first and second ground layers in a direction of the surface, and configured to transmit and/or receive a radio frequency (RF) signal; and a feed line electrically connected to the antenna pattern and extending from the antenna pattern toward the first ground layer in the direction of the surface, wherein the first ground layer includes a first region recessed, relative to the second ground layer, in the direction of the surface.

The antenna apparatus may further include: a feeding via disposed to electrically connect the antenna pattern and the feed line, wherein the antenna pattern is spaced away from the second ground layer by the feeding via.

The antenna apparatus may further include: shielding vias electrically connected to the second ground layer and arranged along a boundary of the first region.

The antenna apparatus may further include: a wiring electrically connected to the feed line; and a third ground layer disposed to surround the wiring, wherein the third ground layer includes a second region recessed, relative to the second ground layer, in the direction of the surface.

The antenna apparatus may further include: a wiring via electrically connected to the wiring; and a fourth ground layer having a through hole through which the wiring via passes, wherein the fourth ground layer includes a third region recessed, relative to the second ground layer, in the direction of the surface.

The first, second, and third regions may have a same rectangular shape.

The antenna pattern may have a form of a dipole, and a total length of the dipole in a length direction may be shorter than a length of the first recessed region in a width direction.

A closest distance between the antenna pattern and a side of the second ground layer in the direction of the surface may be shorter than a recessed length of the first recessed region.

The antenna apparatus may further include: a director pattern spaced apart from the antenna pattern, wherein a distance between the director pattern and the second ground layer in the direction of the surface is greater than the recessed length of the first recessed region.

In another general aspect, an antenna module includes: a connection member including a first ground layer and a second ground layer disposed on a surface of the first ground layer; antenna patterns spaced apart from the first and second ground layers in directions parallel to the surface, and configured to transmit and/or receive a radio frequency (RF) signal; and feed lines each electrically connected to a corresponding antenna pattern among the antenna patterns and extending toward the first ground layer from the corresponding antenna pattern, wherein the first ground layer includes a region protruding toward a region between the antenna patterns.

The protruding region of the first ground layer may provide cavities respectively corresponding to the antenna patterns, and a portion of the second ground layer may be exposed in the cavities.

The connection member may further include a third ground layer disposed on a surface of the first ground layer and protruding toward the region between the antenna patterns to provide the cavities.

The connection member may further include shielding vias disposed to electrically connect the first ground layer and the third ground layer to each other, and arranged along the boundary of each of the cavities.

The antenna module may further include: an integrated circuit (IC) disposed below the connection member, wherein the connection member further includes wirings each electrically connected to a corresponding feed line among the feed lines, and wiring vias each having one end electrically connected to a corresponding wiring among the wirings and another end electrically connected to the IC.

The antenna module may further include: a passive component disposed below the connection member; and a shielding member disposed below the connection member and surrounding the IC, wherein the first and second ground layers are electrically connected to the passive component and the shielding member.

The antenna module may further include: second antenna patterns disposed above the connection member; and second feeding vias each having one end electrically connected to a corresponding second antenna pattern among the second antenna patterns, wherein the connection member further includes second wirings each electrically connected to a corresponding second feeding via among the second feeding vias, and second wiring vias each having one end electrically connected to a corresponding second wiring among the second wirings and another end electrically connected to the IC, and wherein the second ground layer overlaps a portion of each of the feed lines and the protruding region of the first ground layer, and is disposed in a position higher than the first ground layer.

In another general aspect, an antenna apparatus includes: a connection member including a first ground layer and a second ground layer spaced from the first ground layer in a vertical direction; an antenna pattern spaced from the first and second ground layers in a first horizontal direction, and configured to transmit and/or receive a radio frequency (RF) signal; and a feed line electrically connected to the antenna pattern and extending from the antenna pattern toward the first ground layer, wherein the first ground layer includes a recessed portion that is recessed from an end portion of the second ground layer in a second horizontal direction opposite the first horizontal direction.

The antenna apparatus may further include: a cavity formed by the second ground layer and the recessed portion of the first ground layer.

The antenna apparatus may further include: a third ground layer spaced from the first ground layer and the second ground layer in the vertical direction, and including a recessed portion that is recessed from the end portion of the second ground layer in the second horizontal direction, wherein the cavity is further formed by the third ground layer.

The first ground layer may further include side-end portions that protrude from the recessed portion of the first ground layer in the first horizontal direction and form side boundaries of the cavity.

In another general aspect, an antenna apparatus includes: a first ground layer including a recess; a second ground layer including a surface disposed on the first ground layer and a side at an edge of the surface, wherein a portion of the surface is exposed by the recess; a feed line extending away from the first and second ground layers, beyond the side, in a direction parallel to the surface; and an antenna pattern electrically connected to the feed line and configured to transmit and/or receive a radio frequency (RF) signal, wherein the antenna pattern is spaced apart from the first and second ground layers beyond the side in the direction parallel to the surface such that the antenna pattern opposes the recess.

The antenna apparatus may further include: a feeding via disposed to electrically connect the antenna pattern and the feed line, wherein the antenna pattern is spaced away from the surface in a direction perpendicular to the surface by the feeding via.

The antenna apparatus may further include a third ground layer disposed on the first ground layer, wherein the third ground layer includes a second recess exposing the portion of the surface.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
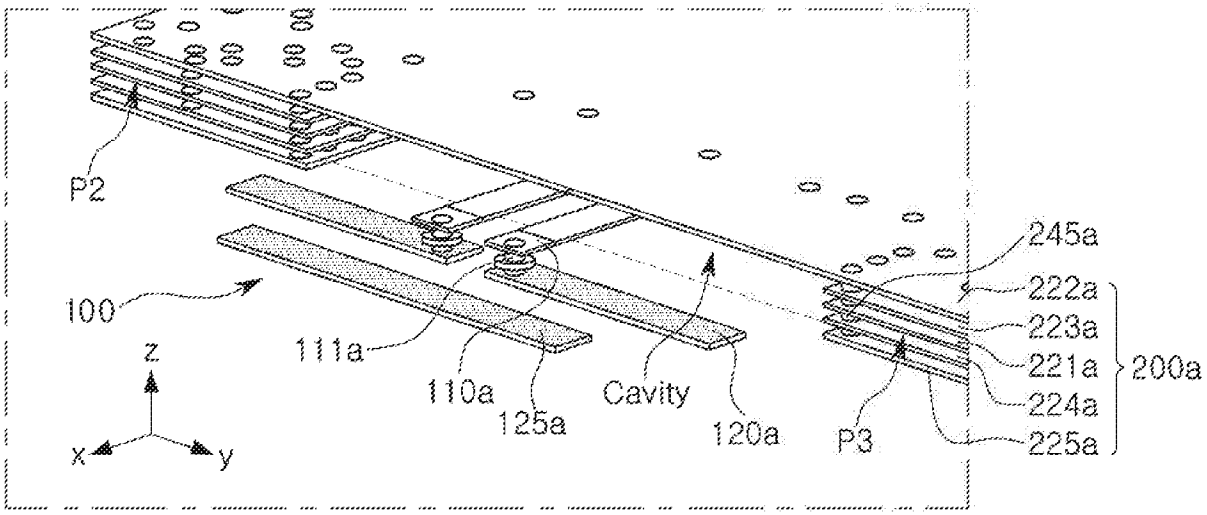
FIG. 1 is a perspective view illustrating an antenna apparatus, according to an embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

The features of the examples described herein may be combined in various ways as will be apparent after an understanding of the disclosure of this application. Further, although the examples described herein have a variety of configurations, other configurations are possible as will be apparent after an understanding of the disclosure of this application.

Figure 2:
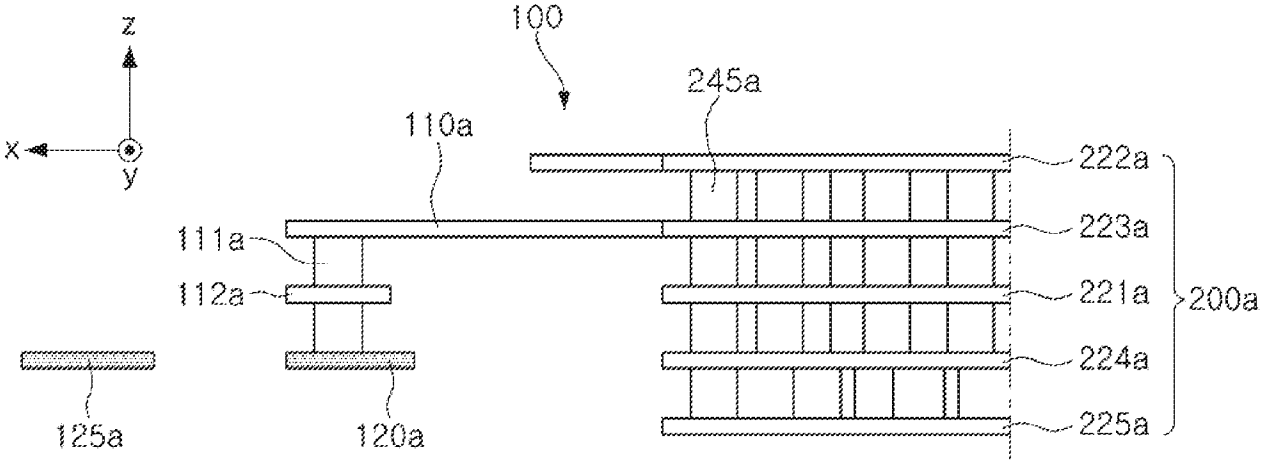
FIG. 2 is a side view illustrating the antenna apparatus of FIG. 1.

FIG. 1 is a perspective view illustrating an antenna apparatus 100, according to an embodiment. FIG. 2 is a side view illustrating the antenna apparatus 100.

Referring to FIGS. 1 and 2, an antenna apparatus 100 may include an antenna pattern 120*a* and a connection member 200*a*. The antenna pattern 120*a* may receive a radio frequency (RF) signal from the connection member 200*a* via a feed line 110*a* and remotely transmit the RF signal in the x direction, or the antenna pattern 120*a* may remotely receive an RF signal in the x direction and transfer the received RF signal to the connection member 200*a* via the feed line 110*a*. For example, the antenna pattern 120*a* may have a dipole shape, and thus, the antenna pattern 120*a* may have a structure extending in the yz direction.

Referring to FIGS. 1 and 2, the connection member 200*a* may include at least a portion of a first ground layer 221*a*, a second ground layer 222*a*, a third ground layer 223*a*, a fourth ground layer 224*a*, and a fifth ground layer 225*a*, and may further include an insulating layer disposed between adjacent ground layers among the first to fifth ground layers 221*a*, 222*a*, 223, 224*a*, and 225*a*. The first to fifth ground layers 221*a*, 222*a*, 223*a*, 224*a*, and 225*a* may be spaced apart from each other in a vertical direction (z direction).

The antenna apparatus may include at least one of first to fifth ground layers 221*a*, 222*a*, 223*a*, 224*a*, and 225*a*. The number and a vertical relationship of the first to fifth ground layers 221*a*, 222*a*, 223*a*, 224*a*, and 225*a* may vary depending on the design of the antenna apparatus 100.

For example, the first to fifth ground layers 221*a*, 222*a*, 223*a*, 224*a*, and 225*a* may each include surfaces extending in the x and y directions (e.g., in the xy plane). Thus, each of the first to fifth ground layers 221*a*, 222*a*, 223*a*, 224*a*, and 225*a* may be disposed (indirectly) on a surface of an adjacent ground layer among the first to fifth ground layers 221*a*, 222*a*, 223*a*, 224*a*, and 225*a*.

The fourth and fifth ground layers 224*a* and 225*a* may provide a ground used in circuitry and/or a passive component of an integrated circuit (IC) as an IC and/or a passive component. In addition, the fourth and fifth ground layers 224*a* and 225*a* may provide a transfer path of power and a signal used in the IC and/or passive component. Thus, the fourth and fifth ground layers 224*a* and 225*a* may be electrically connected to the IC and/or passive component.

The fourth and fifth ground layers 224*a* and 225*a* may be omitted depending on ground requirements of the IC and/or passive component. The fourth and fifth ground layers 224*a* and 225*a* may have a through hole through which a wiring via passes.

The third ground layer 223*a* may be disposed above the fourth and fifth ground layers 224*a* and 225*a*, spaced apart therefrom, and may surround a wiring, through which an RF signal flows, at the same height as that of the wiring. The wiring may be electrically connected to the IC via the wiring via.

The first and second ground layers 221*a* and 222*a* may be disposed above the fourth and fifth ground layers 224*a* and 225*a*, spaced apart therefrom, and may be disposed above and below the third ground layer 223*a*, respectively. The first ground layer 221*a* may improve electromagnetic isolation between the wiring and the IC and provide ground to the IC and/or passive component. The second ground layer 222*a* may enhance electromagnetic isolation between the wiring and a patch antenna pattern, provide a boundary condition for the patch antenna pattern, and reflect an RF signal transmitted/received by the patch antenna pattern to further concentrate a transmission/reception direction of the patch antenna pattern.

The second ground layer 222*a* may not be recessed backwards (in an opposite direction of the x direction). Accordingly, the second ground layer 222*a* may electromagnetically shield between the patch antenna pattern and the antenna pattern 120*a*, and accordingly, electromagnetic isolation between the patch antenna pattern and the antenna pattern 120*a* may be improved.

The boundaries of the first, third, fourth, and fifth ground layers 221*a*, 223*a*, 224*a*, and 225*a* may overlap one another when viewed in the vertical direction (z direction). That is, the boundaries of the first, third, fourth, and fifth ground layers 221*a*, 223*a*, 224*a* may overlap one another in the x and y directions. The boundaries may act as a reflector for the antenna pattern 120*a*, and thus, an effective distance between the first, third, fourth and fifth ground layers 221*a*, 223*a*, 224*a*, and 225*a* and the antenna pattern 120*a* may affect antenna performance of the antenna pattern 120*a*.

For example, if the effective distance were to be shorter than a reference distance, a gain of the antenna pattern 120*a* may deteriorate according to dispersion of the RF signal transmitted through the antenna pattern 120*a*, and a resonance frequency of the antenna pattern 120*a* may be difficult to optimize due to an increase in capacitance between the first, third, fourth, and fifth ground layers 221*a*, 223*a*, 224*a*, and 225*a* and the antenna pattern 120*a*.

Also, if the antenna pattern 120*a* were to be disposed far away from the first, third, fourth, and fifth ground layers 221*a*, 223*a*, 224*a*, and 225*a*, the sizes of the antenna apparatus 100 and an antenna module including the antenna apparatus 100 may be increased.

In addition, if the connection member 200*a* were to be small, a transfer path of power and a signal and a disposition space of wirings may be insufficient, ground stability of the ground layers 221*a*, 223*a*, 224*a*, and 225*a* may deteriorate, and a disposition space of the patch antenna pattern may be insufficient. That is, performance of the antenna apparatus 100 and the antenna module may deteriorate.

The antenna apparatus 100 and the antenna module may have a structure in which the effective distance between the first, third, fourth, and fifth ground layers 221*a*, 223*a*, 224*a*, and 225*a* and the antenna pattern 120 is provided, while the antenna pattern 120*a* is disposed close to the first, third, fourth, and fifth ground layers 221*a*, 223*a*, 224*a*, and 225*a*. Accordingly, the antenna apparatus 100 and the antenna module may have a reduced size and/or improved performance.

Referring to FIGS. 1 and 2, at least one of the first, third, fourth, and fifth ground layers 221*a*, 223*a*, 224*a*, and 225*a* included in the connection member 200*a* may be recessed as compared with the second ground layer 222*a* in a direction in which the feed line 110*a* extends (the opposite direction of the x direction).

Accordingly, at least one of the first, third, fourth, and fifth ground layers 221*a*, 223*a*, 224*a*, and 225*a* may form a cavity and may have second and third protruding regions, or side-end portions, P2 and P3 forming a boundary of first and second sides (extending in the y direction) of the cavity. The protruding regions P2 and P3 may protrude in the x direction. The cavity may provide a boundary condition advantageous for ensuring antenna performance of the antenna pattern 120*a*.

As the number of ground layers providing the cavities, among the first, third, fourth, and fifth ground layers 221*a*, 223*a*, 224*a*, and 225*a*, increases, the length of the cavities in the vertical direction (z direction) may be increased. The length of the cavities in the vertical direction (z direction) may affect antenna performance of the antenna pattern 120*a*. In the antenna apparatus 100 and the antenna module, since the length of the cavities in the vertical direction (z direction) may be easily adjusted by adjusting the number of the ground layers forming the cavities, antenna performance of the antenna 120*a* may be more easily adjusted in comparison to conventional antenna modules.

Recessed regions of at least two of the first, third, fourth, and fifth ground layers 221*a*, 223*a*, 224*a*, and 225*a* may have the same rectangular shape. Accordingly, the cavities may form a rectangular parallelepiped. When the cavities are a rectangular parallelepiped, the ratio of an x vector component of the RF signal reflected from the boundary of the cavities, among the x vector component and a y vector component, may be further increased. Since the y vector component is more easily canceled out in the cavities than the x vector component, the antenna pattern 120*a* may have a higher gain ratio as the ratio of the x vector component of the RF signal reflected from the boundary of the cavities increases. Accordingly, the antenna pattern 120*a* may have a further improved gain the closer the cavities are to a rectangular parallelepiped.

Since the boundary of at least one of the first, third, fourth and fifth ground layers 221*a*, 223*a*, 224*a* and 225*a* facing the antenna pattern 120*a* may act as a reflector for the antenna pattern 120*a*, a portion of an RF signal transmitting through the antenna pattern 120*a* may be reflected from the boundary of at least one of the first, third, fourth, and fifth ground layers 221*a*, 223*a*, 224*a*, and 225*a*. That is, the cavity may act as a reflector with respect to the antenna pattern 120*a*.

Accordingly, an effective distance from the antenna pattern 120*a* to at least one of the first, third, fourth, and fifth ground layers 221*a*, 223*a*, 224*a*, and 225*a* may be increased, even without a substantial change in position of the antenna pattern 120*a*. Alternatively, the antenna pattern 120*a* may be disposed closer to the first, third, fourth, and fifth ground layers 221*a*, 223*a*, 224*a*, and 225*a*, without substantial sacrifice of antenna performance.

For example, an RF signal moving toward the cavity, among RF signals transmitting through each pole of the antenna pattern 120*a*, may be further concentrated and reflected in the x direction, compared with a case in which the cavity is not present. Thus, a gain of the antenna pattern 120*a* may be further improved as compared with the case in which the cavity is not present.

Also, the second and third protruding regions P2 and P3 may electromagnetically shield between the antenna pattern 120*a* and the adjacent antenna apparatus. Accordingly, a distance between the antenna pattern 120*a* and the adjacent antenna apparatus may be further reduced and the size of the antenna module including the antenna apparatus 100 may be reduced in comparison to conventional antenna modules.

Referring to FIGS. 1 and 2, the connection member 200*a* may further include shielding vias 245*a* electrically connected to at least two of the first, third, fourth, and fifth ground layers 221*a*, 223*a*, 224*a*, and 225*a* and arranged to surround at least a portion of the cavity when viewed in the vertical direction (Z direction). That is, the shielding vias 245*a* may surround at least a portion of the cavity in the x direction and/or the y direction.

The shielding vias 245*a* may reflect an RF signal leaked to gaps between the first, third, fourth, and fifth ground layers 221*a*, 223*a*, 224*a*, and 225*a*, among RF signals transmitting through the antenna pattern 120*a*. Thus, the gain of the antenna pattern 120*a* may be further improved and electromagnetic isolation between the antenna pattern 120*a* and the wiring may be improved.

Still referring to FIGS. 1 and 2, the antenna apparatus 100 may include at least some of a feed line 110*a*, a feeding via 111*a*, the antenna pattern 120*a*, a director pattern 125*a*, and the connection member 200*a*.

Since the feed line 110*a* may be electrically connected to the wiring in the third ground layer 223*a*, the feed line 110*a* may act as a transfer path of the RF signal. The feed line 110*a* may be considered to be a component included in the third ground layer 223*a*. Since the antenna pattern 120*a* may be disposed adjacent to the side of the connection member 200*a*, the feed line 110*a* may have a structure extending from the wiring of the third ground layer 223*a* toward the antenna pattern 120*a*.

At least a portion of the feed line 110*a* may be overlapped by the second ground layer 222*a* when viewed in the vertical direction (z direction). In other words, at least a portion of the feed line 110*a* may be overlapped by the second ground layer 222*a* in the x and y directions. Accordingly, the feed line 110*a* may reduce electromagnetic noise that may be received from the patch antenna pattern disposed above the second ground layer 222*a*.

The feed line 110*a* may include first and second feed lines. For example, the first feed line may transfer an RF signal to the antenna pattern 120*a*, and the second feed line may receive the RF signal from the antenna pattern 120*a*. For example, the first feed line may receive an RF signal from the antenna pattern 120*a* or transfer an RF signal to the antenna pattern 120*a*, and the second feed line may provide impedance to the antenna pattern 120*a*.

For example, the first and second feed lines may each transfer an RF signal to the antenna pattern 120*a* and receive an RF signal from the antenna pattern 120*a* and may be configured in a differential feeding manner to have a phase difference (e.g., 180° and 90°). The phase difference may be realized through a phase shifter of the IC or a difference in electrical length between the first and second feed lines.

Meanwhile, according to the design, the feed line 110*a* may include a ¼ wavelength converter, a balun, or an impedance conversion line to improve RF signal transmission efficiency. However, the ¼ wavelength converter, the balun, or the impedance conversion line may be omitted depending on the design.

The feeding via 111*a* may be disposed to electrically connect the antenna pattern 120*a* and the feed line 110*a*. The feeding via 111*a* may be disposed perpendicular to the antenna pattern 120*a* and the feed line 110*a*. In an alternative example in which the antenna pattern 120*a* and the feed line 110*a* are arranged at the same height in the z direction, the feeding via 111*a* may be omitted.

Due to the feeding via 111*a*, the antenna pattern 120*a* may be disposed at a position higher or lower than the feed line 110*a*. A specific position of the antenna pattern 120*a* may vary depending on the length of the feeding via 111*a*, and thus, a radiation pattern direction of the antenna pattern 120*a* may be slightly tilted in the vertical direction (z direction) according to the length of the feeding via 111*a*.

For example, the antenna pattern 120*a* may be disposed below the feed line 110*a* to be vertically spaced from the second ground layer 222*a* by the feeding via 111*a*. Accordingly, the second ground layer 222*a* may further improve electromagnetic isolation between the antenna pattern 120*a* and the upper patch antenna pattern.

A via pattern 112*a* may be coupled to the feeding via 111*a* and may support each of upper and lower portions of the feeding via 111*a*.

The antenna pattern 120*a* may be electrically connected to the feed line 110*a* and may transmit or receive an RF signal. One end of each pole of the antenna pattern 120*a* may be electrically connected to first and second lines of the feed line 110*a*.

The antenna pattern 120*a* may have a frequency band (e.g., 28 GHz, 60 GHz) in accordance with at least one of a pole length, a pole thickness, an interval between poles, a distance between a pole and a side surface of a connection member, and permittivity of an insulating layer.

The antenna pattern 120*a* and the director pattern 125*a* may be considered to be components included in the fourth ground layer 224*a*. The director pattern 125*a* may be omitted in alternative embodiments, depending on design and performance considerations.

The director pattern 125*a* may be laterally spaced apart from the antenna pattern 120*a* in the x direction. The director pattern 125*a* may be electromagnetically coupled to the antenna pattern 120*a* to improve a gain or a bandwidth of the antenna pattern 120*a*. Since the director pattern 125*a* has a length shorter than a total length of a dipole of the antenna pattern 120*a*, concentration of electromagnetic coupling of the antenna pattern 120*a* may be further improved, and thus, a gain and directivity of the antenna pattern 120*a* may be further improved.

Since the antenna pattern 120*a* of the antenna apparatus 100 and the antenna module may be further compressed, a space occupied by the director pattern 125*a* may be increased in comparison to conventional antenna apparatuses and antenna modules. That is, the antenna apparatus 100 and the antenna module may prevent a substantial increase in size in comparison to conventional antenna apparatuses and antenna modules, while improving antenna performance through the director pattern 125*a*.

FIGS. 3A through 3D are plan views illustrating the first to fourth ground layers 221*a*, 222*a*, 223*a*, and 224*a* that may be included in the antenna apparatus 100 and an antenna module, according to an embodiment.

Figure 3A:
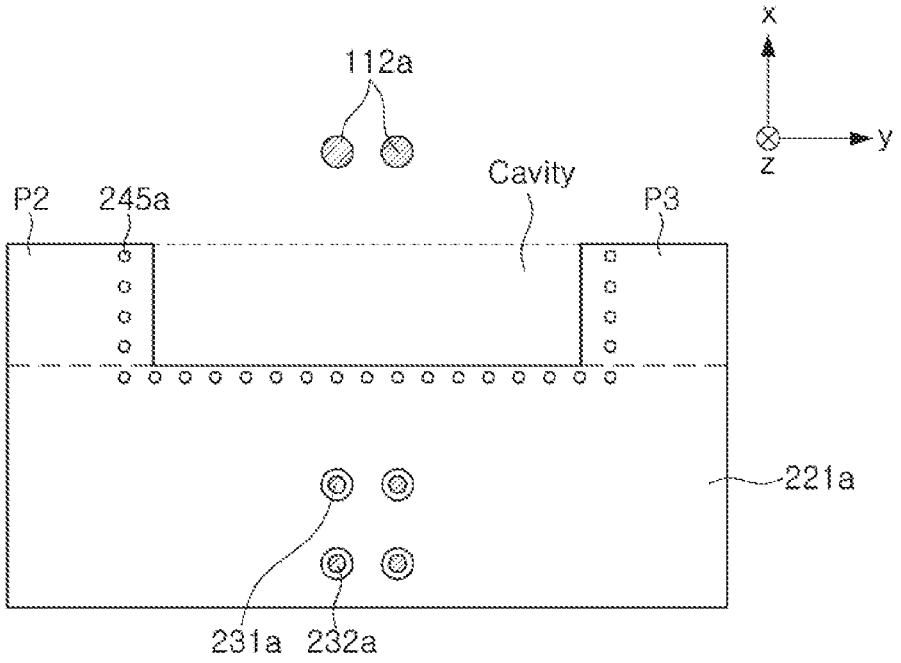
FIGS. 3A through 3D are plan views illustrating first to fourth ground layers that may be included in an antenna apparatus and an antenna module, according to an embodiment.

Referring to FIG. 3A, the shielding vias 245*a* may be electrically connected to the first ground layer 221*a* and may be arranged along the boundary of a region between the second and third protruding regions P2 and P3. In addition, the first ground layer 221*a* may have through holes through which first and second wiring vias 231*a* and 232*a* pass. Meanwhile, the via pattern 112*a* coupled to the feeding via may be considered to be a component included in the first ground layer 221*a*.

Figure 3B:
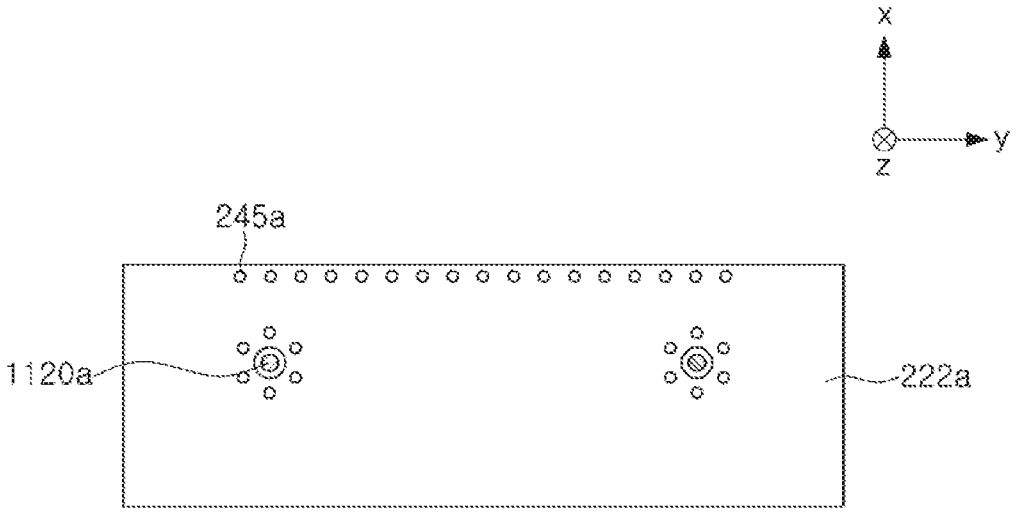

Referring to FIGS. 3A and 3B, the second ground layer 222*a* may overlap the cavity of the first ground layer 221*a* when viewed in the vertical direction (z direction). That is, the second ground layer 222*a* may overlap the cavity of the first ground layer 221*a* in the x and y directions. Accordingly, the antenna pattern 120*a* may provide electromagnetic isolation for the patch antenna pattern disposed above the second ground layer 222*a*.

Also, the shielding vias 245*a* may be electrically connected to the second ground layer 222*a* and may be arranged along the boundary of the second ground layer 222*a*. In addition, the second ground layer 222*a* may have a through hole through which a second feeding via 1120*a* passes. The second feeding via 1120*a* may electrically connect the patch antenna pattern and a second wiring.

Figure 3C:
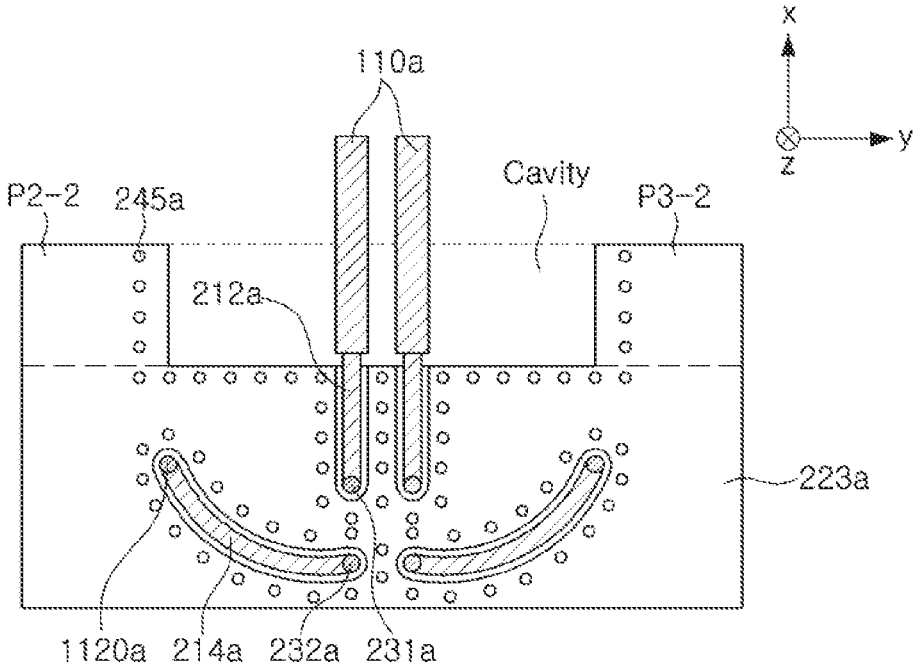

Referring to FIG. 3C, the antenna apparatus 100 and the antenna module may include a first wiring 212*a* for electrically connecting the feed line 110*a* and the first wiring via 231*a* to each other, and a second wiring 214*a* electrically connecting the second feeding via 1120*a* and the second wiring via 232*a* to each other.

The third ground layer 223*a* may be disposed to surround each of the first wiring 212*a* and the second wiring 214*a*. Accordingly, electromagnetic noise of each of the first wiring 212*a* and the second wiring 214*a* may be reduced.

The shielding vias 245*a* may be electrically connected to the third ground layer 223*a* and may be arranged along the boundary of the third ground layer 223*a* and the first and second wirings 212*a* and 214*a*. Accordingly, electromagnetic noise of each of the first wiring 212*a* and the second wiring 214*a* may be further reduced.

Referring to FIGS. 3A and 3C, the third ground layer 223*a* may be configured such that a region of the third ground layer 223*a* between the second protruding region P2 and the third protruding region P3 of the first ground layer 221*a* is recessed when viewed in the vertical direction (z direction) to provide a cavity. In other words, a region of the third ground layer 223*a* between the second protruding region P2 and the third protruding region P3 of the first ground layer 221*a* is recessed in a direction opposite the x direction. That is, the third ground layer 223*a* may have a second protruding region P2-2 and a third protruding region P3-2.

Figure 3D:
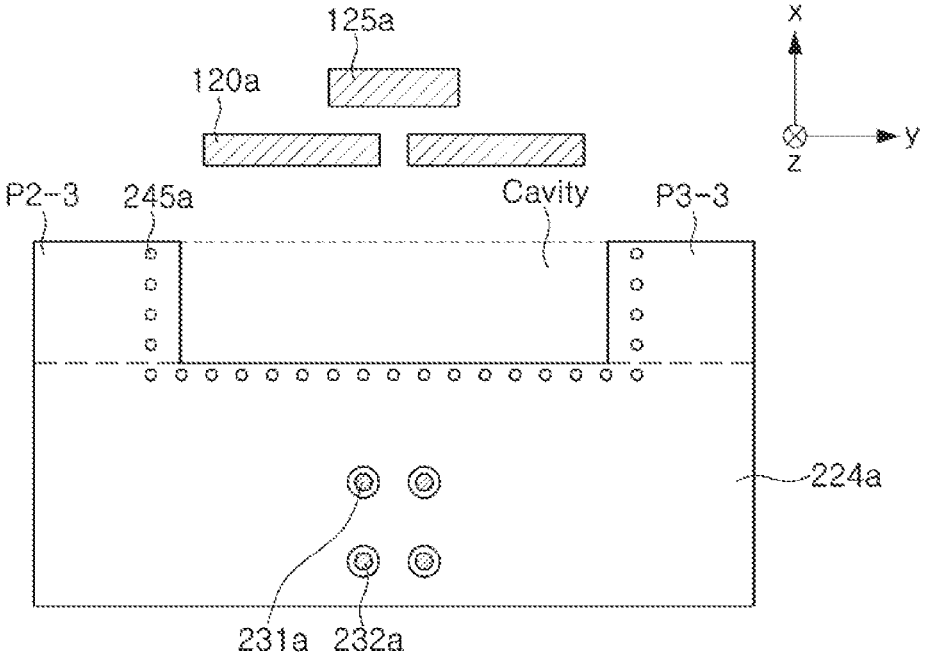

Referring to FIGS. 3A and 3D, the fourth ground layer 224*a* may be configured such that a region thereof between the second protruding region P2 and the third protruding region P3 of the first ground layer 221*a* is recessed when viewed in the vertical direction (z direction) to provide a cavity. In other words, a region of the fourth ground layer 224*a* between the second protruding region P2 and the third protruding region P3 of the first ground layer 221*a* is recessed in a direction opposite the x direction. That is, the fourth ground layer 224*a* may have a second protruding region P2-3 and a third protruding region P3-3.

The shielding vias 245*a* may be electrically connected to the fourth ground layer 224*a* and arranged to surround a region between the second protruding area P2-3 and the third protruding area P3-3.

The fourth ground layer 224*a* may have through holes through which the first and second wiring vias 231*a* and 232*a* pass. The first and second wiring vias 231*a* and 232*a* may be electrically connected to the IC disposed below the fourth ground layer 224*a*.

The antenna pattern 120*a* and the director pattern 125*a* may be considered to be components included in the fourth ground layer 224*a*.

FIGS. 4A through 4D are plan views illustrating various arrangement positions of antenna patterns of an antenna apparatus, according to embodiments.

Figure 4A:
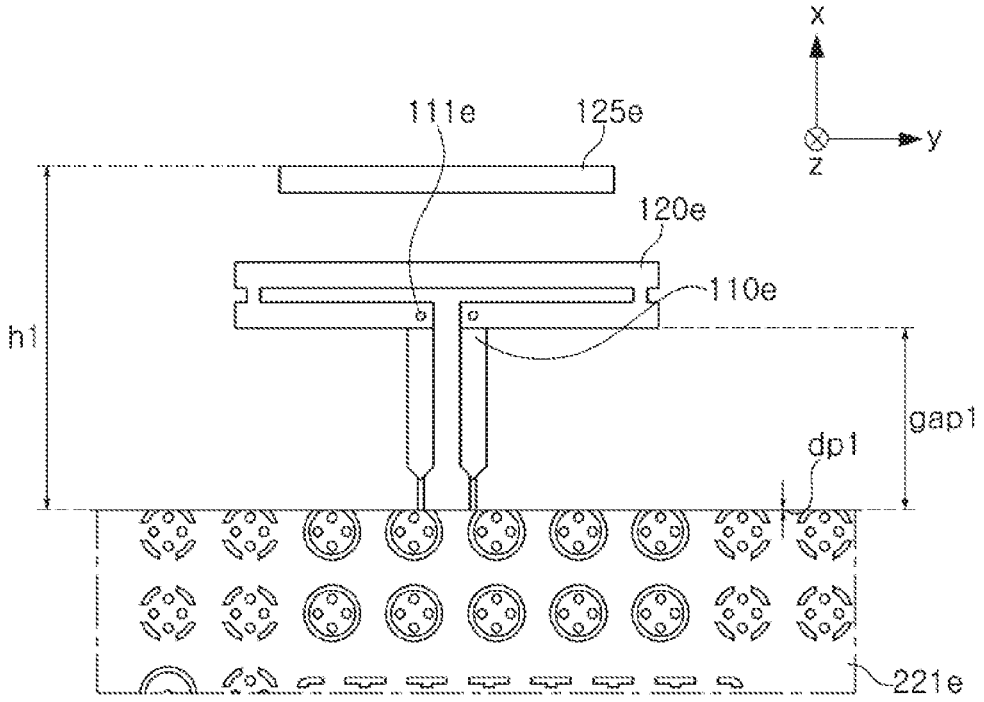
FIGS. 4A through 4D are plan views illustrating various arrangement positions of antenna patterns of an antenna apparatus, according to embodiments.

Referring to FIG. 4A, an antenna apparatus and/of an antenna module, according to an embodiment, may include at least some of a feed line 110*e*, a feeding via 111*e*, an antenna pattern 120*e*, a director pattern 125*e*, and a first ground layer 221*e*. A depth dp1 of a region cut in the first ground layer 221*e* may be 0 mm, a distance h1 from a front boundary of the first ground layer 221*e* to a front boundary of the director pattern 125*e* may be 2.33 mm, and a distance gap1 from the front boundary of the first ground layer 221*e* to a rear boundary of the antenna pattern 120*e* may be 1.19 mm.

Figure 4B:
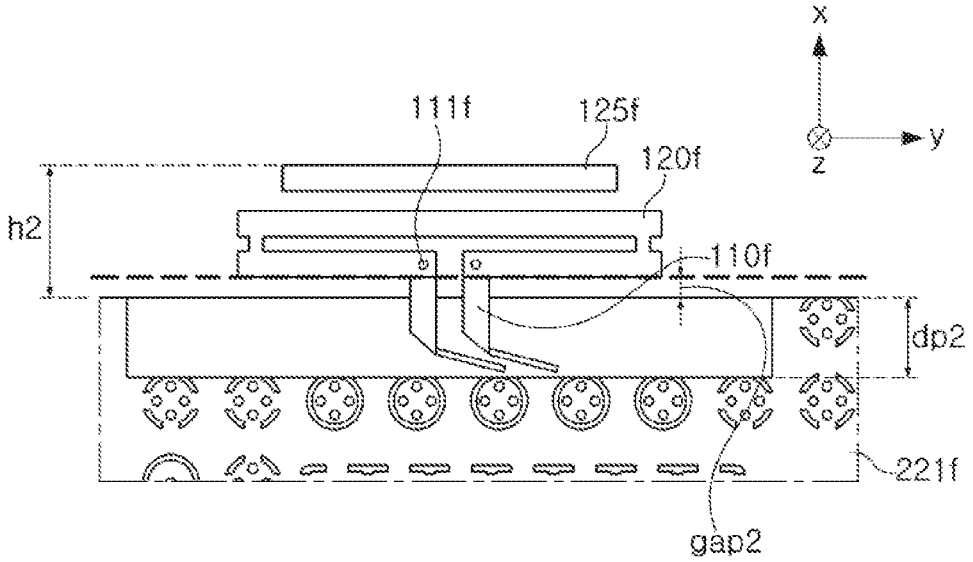

Referring to FIG. 4B, an antenna apparatus and/of an antenna module, according to an embodiment, may include at least some of a feed line 110*f*, a feeding via 111*f*, an antenna pattern 120*f*, a director pattern 125*f*, and a first ground layer 221*f*. A depth dp2 of a region cut in the first ground layer 221*f* may be 0.6 mm, a distance h2 from a front boundary of the first ground layer 221*f* to a front boundary of the director pattern 125*f* may be 0.98 mm, and a distance gap2 from the front boundary of the first ground layer 221*f* to a rear boundary of the antenna pattern 120*f* may be 0.15 mm.

Figure 4C:
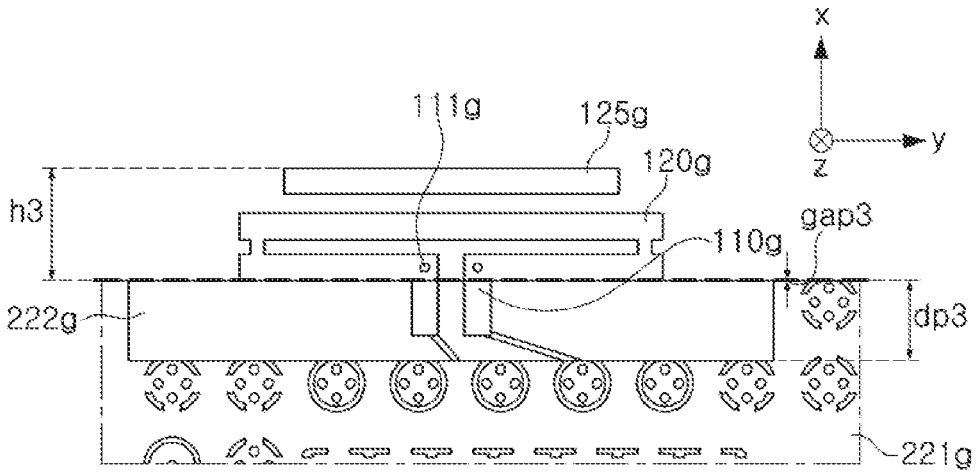

Referring to FIG. 4C, an antenna apparatus and/of an antenna module, according to an embodiment, may include at least some of a feed line 110*g*, a feeding via 111*g*, an antenna pattern 120*g*, a director pattern 125*g*, and a first ground layer 221*g*. A depth dp3 of a region cut in the first ground layer 221*g* may be 0.6 mm, a distance h3 from a front boundary of the first ground layer 221*g* to a front boundary of the director pattern 125*g* may be 0.856 mm, and a distance gap3 from the front boundary of the first ground layer 221*g* to a rear boundary of the antenna pattern 120*g* may be 0 mm.

Figure 4D:
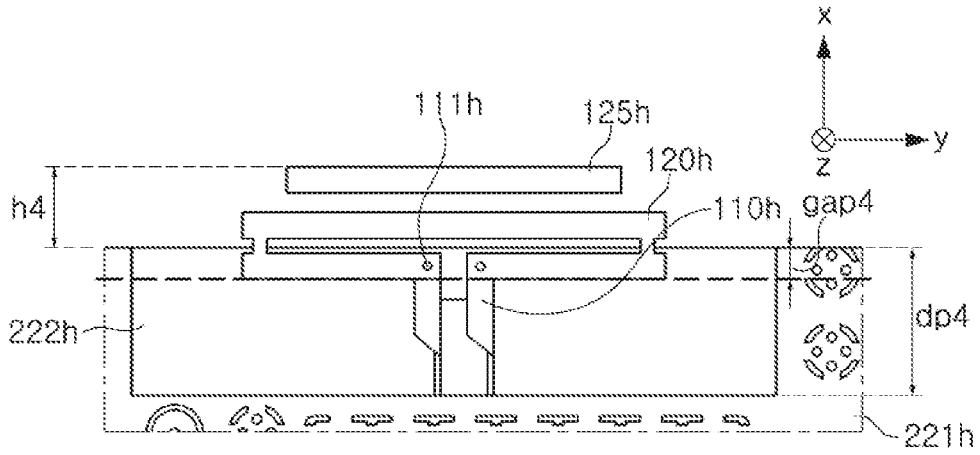

Referring to FIG. 4D, an antenna apparatus and/of an antenna module, according to an embodiment, may include at least some of a feed line 110*h*, a feeding via 111*h*, an antenna pattern 120*h*, a director pattern 125*h*, and a first ground layer 221*h*. A depth dp4 of a region cut in the first ground layer 221*h* may be 1.0 mm, a distance h4 from a front boundary of the first ground layer 221*h* to a front boundary of the director pattern 125*h* may be 0.584 mm, and a distance gap4 from the front boundary of the first ground layer 221*h* to a rear boundary of the antenna pattern 120*h* may be −0.25 mm.

FIGS. 5A to 5D are plan views illustrating various widths of recessed regions of an antenna apparatus, according to embodiments.

Figure 5A:
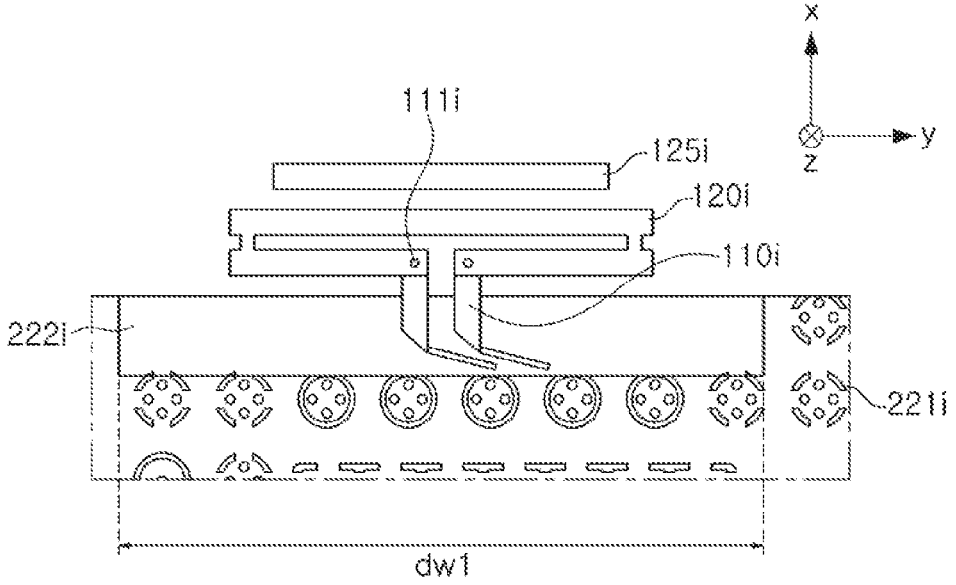
FIGS. 5A to 5D are plan views illustrating various widths of recessed regions of an antenna apparatus, according to embodiments.

Referring to FIG. 5A, an antenna apparatus and/of an antenna module, according to an embodiment, may include at least some of a feed line 110*i*, a feeding via 111*i*, an antenna pattern 120*i*, a director pattern 125*i*, and a first ground layer 221*i*. A depth of a region cut in the first ground layer 221*i* may be 0.6 mm and a width dw1 of the region cut in the first ground layer 221*i* may be 4.71 mm.

Figure 5B:
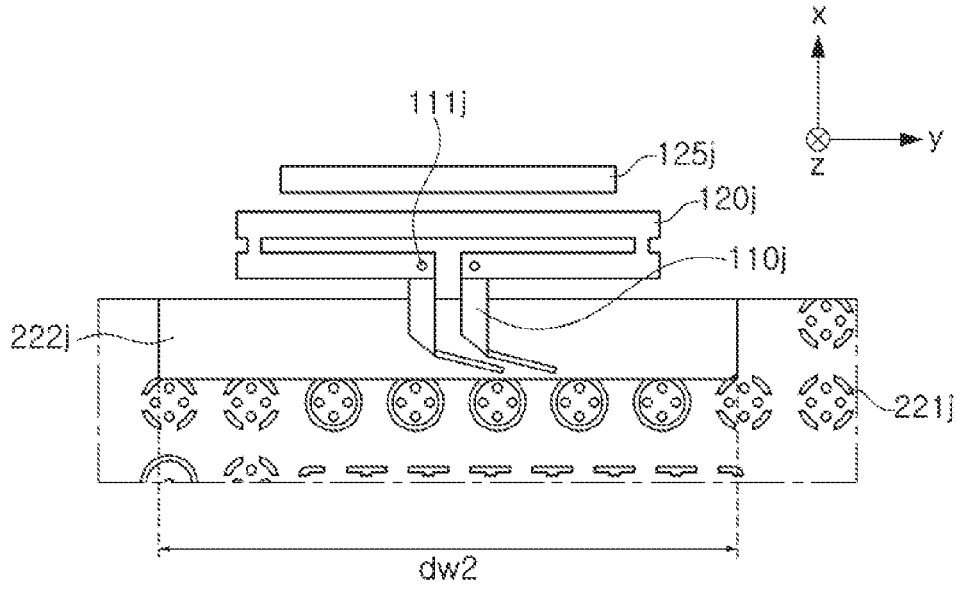

Referring to FIG. 5B, an antenna apparatus and/of an antenna module, according to an embodiment, may include at least some of a feed line 110*j*, a feeding via 111*j*, an antenna pattern 120*j*, a director pattern 125*j*, and a ground layer 221*j*. A depth of a region cut in the first ground layer 221*j* may be 0.6 mm and a width dw2 of the region cut in the first ground layer 221*j* may be 4.21 mm.

Figure 5C:
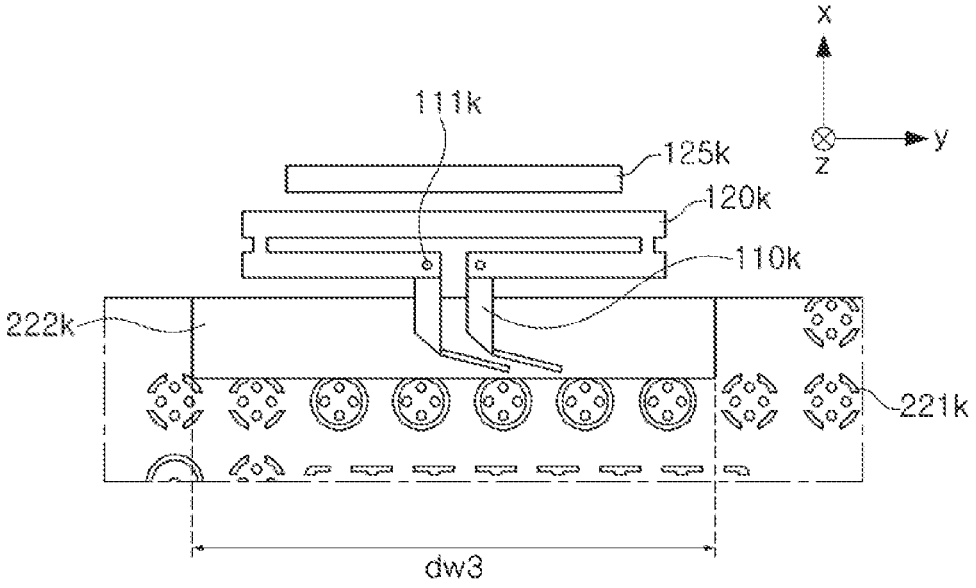

Referring to FIG. 5C, an antenna apparatus and/of an antenna module, according to an embodiment, may include at least some of a feed line 110*k*, a feeding via 111*k*, an antenna pattern 120*k*, a director pattern 125*k*, and a first ground layer 221*k*. A depth of a region cut in the first ground layer 221*k* may be 0.6 mm and a width dw3 of the region cut in the first ground layer 221*k* may be 3.71 mm.

Figure 5D:
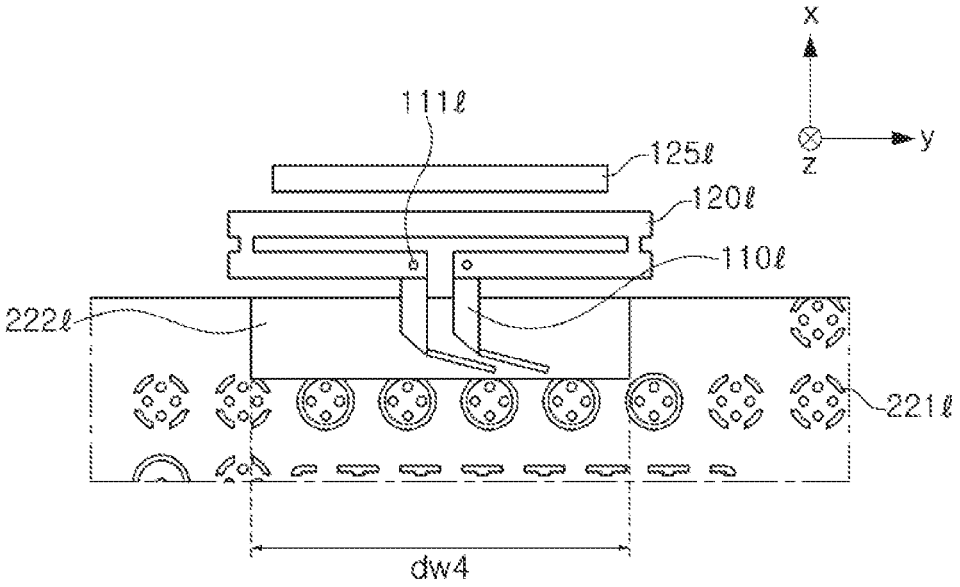

Referring to FIG. 5D, an antenna apparatus and/of an antenna module, according to an embodiment, may include at least some of a feed line 110*l*, a feeding via 111*l*, an antenna pattern 120*l*, a director pattern 125*l*, and a first ground layer 221*l*. A depth of a region cut in the first ground layer 221*l* may be 0.6 mm and a width dw4 of the region cut in the first ground layer 221*l* may be 2.71 mm and may be shorter than the width of the antenna pattern 120*l*.

Figure 6A:
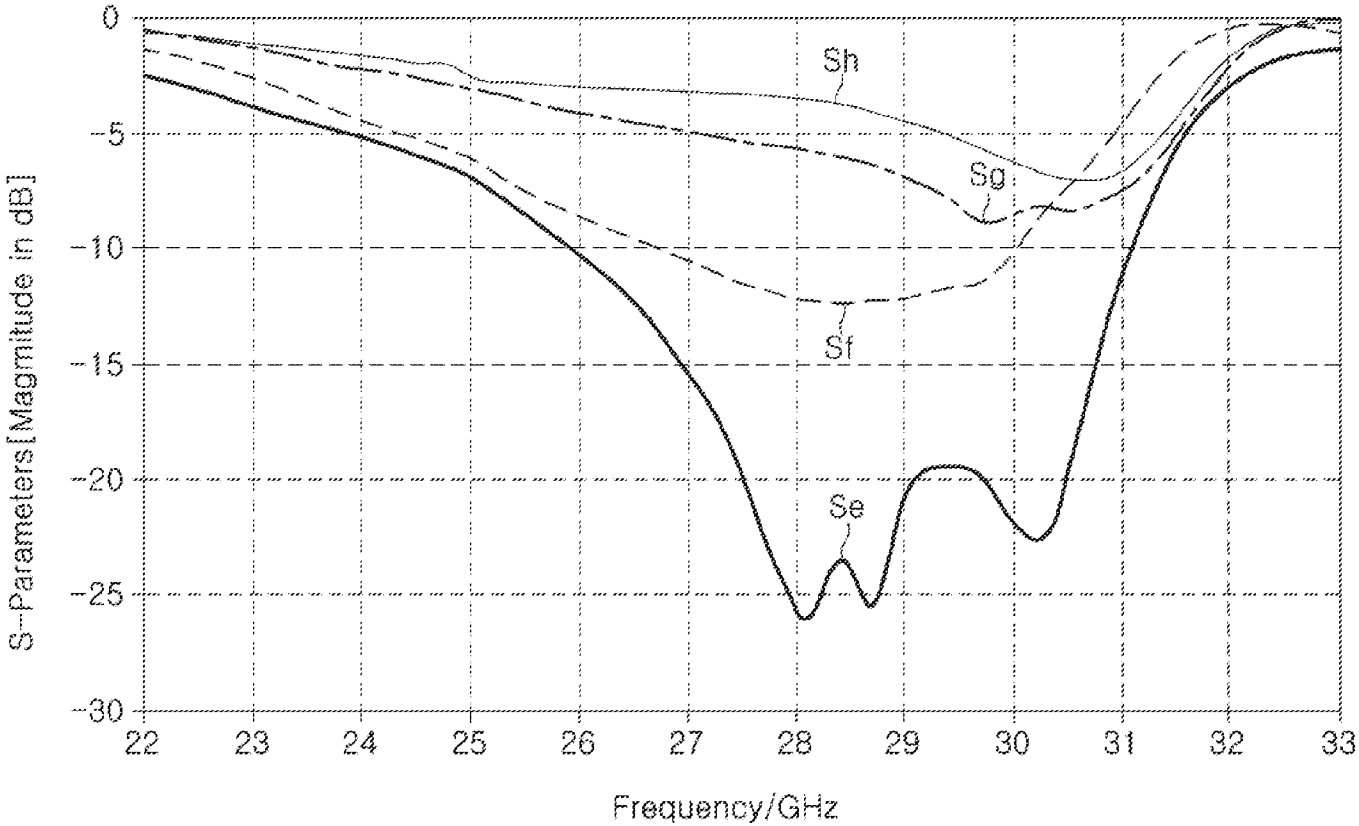
FIG. 6A is a graph illustrating an S-parameter according to various positional relations of antenna patterns illustrated in FIGS. 4A through 4D.

FIG. 6A is a graph illustrating an S-parameter according to various positional relations of the antenna patterns 120*e* through 120*h* illustrated in FIGS. 4A through 4D, respectively.

Referring to FIG. 6A, a first curve Se represents an S-parameter according to a positional relation of the antenna apparatus illustrated in FIG. 4A, a second curve Sf represents an S-parameter according to a positional relation of the antenna apparatus illustrated in FIG. 4B, a third curve Sg represents an S-parameter according to a positional relation of the antenna apparatus illustrated in FIG. 4C, and a fourth curve Sh represents an S-parameter according to a positional relation of the antenna apparatus illustrated in FIG. 4D.

In the first curve Se and the second curve Sf, the S-parameter value (e.g., the ratio of energy reflected to a first port to energy incident from the first port) at 28 GHz may be lower than a predetermined value (e.g., −11 dB). Since the first ground layer 221*e* of the antenna apparatus illustrated in FIG. 4A is not recessed, the antenna apparatus illustrated in FIG. 4A has a larger size than the antenna apparatus illustrated in FIG. 4B. That is, the antenna apparatus illustrated in FIG. 4B may have a reduced size, while ensuring antenna performance (e.g., gain and bandwidth).

According to a generalized example, in order to make the S-parameter value at the frequency of an RF signal lower than a predetermined value, the distance gap2 between the antenna pattern 120*f* and the second ground layer 221*f* when viewed in the vertical direction (z direction) may be shorter than the recessed length dp2 of the recessed region of the first ground layer 221*f*. That is, the distance gap2 between the antenna pattern 120*f* and the second ground layer 221*f* in the x direction may be shorter than the recessed length dp2 of the recessed region of the first ground layer 221*f*. For example, an antenna apparatus and an antenna module according to an embodiment may have a gap of about 0.014 times or greater than the wavelength of the RF signal.

Also, in the embodiment of FIG. 4B, the distance h2 between the director pattern 125*f* and the second ground layer 221*f* when viewed in the vertical direction (z direction) may be longer than the recessed length dp2 of the recessed region of the first ground layer. That is, in the x direction, the recessed length dp2 may be longer than the distance gap2 and shorter than the distance h2. Accordingly, the antenna apparatus and the antenna module according to an embodiment may have a reduced size, while ensuring antenna performance (e.g., bandwidth, directivity, etc.). This, however, may vary depending on design conditions.

Figure 6B:
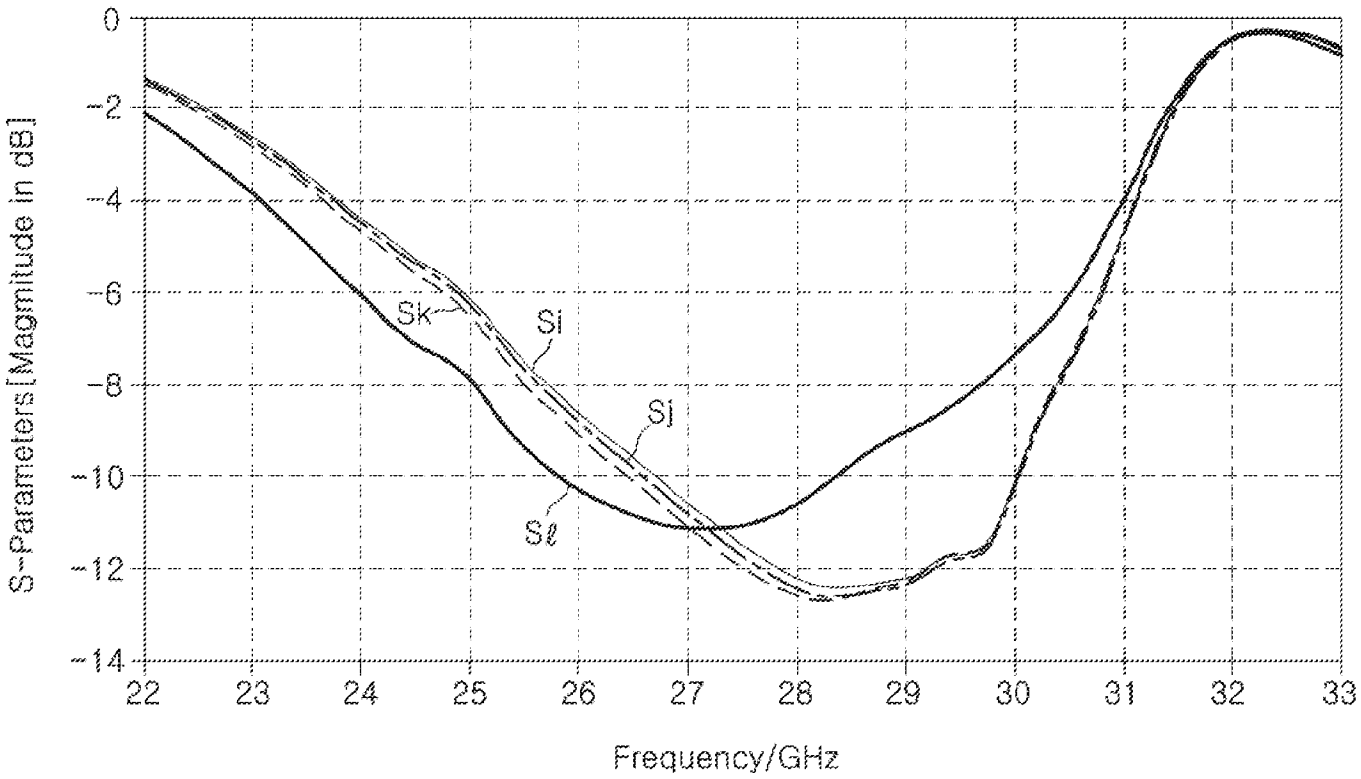
FIG. 6B is a graph illustrating an S-parameter according to various widths of the recessed regions illustrated in FIGS. 5A through 5D.

FIG. 6B is a graph illustrating an S-parameter according to various widths of the recessed regions illustrated in FIGS. 5A through 5D.

Referring to FIG. 6B, a fifth curve Si represents an S-parameter according to a positional relation of the antenna apparatus illustrated in FIG. 5A, a sixth curve Sj represents an S-parameter according to a positional relation of the antenna apparatus illustrated in FIG. 5B, a seventh curve Sk represents an S-parameter according to a positional relation of the antenna apparatus illustrated in FIG. 5C, and an eighth curve SI represents an S-parameter according to a positional relation of the antenna apparatus illustrated in FIG. 5D.

In the fifth curve Si, the sixth curve Sj, and the seventh curve Sk, the S-parameter values (e.g., the ratio of energy reflected to the first port to energy incident from the first port) at 28 GHz may be lower than a predetermined value (e.g., −11 dB).

According to a generalized example, in order to optimize the S-parameters, a total length of the dipole of the antenna pattern in the length direction when viewed in the vertical direction (z direction) may be shorter than the widths (dw1, dw2, and dw3) of the recessed regions of the first ground layer. That is, a total length of the dipole of the antenna pattern in the xy plane may be shorter than the widths (dw1, dw2, and dw3) of the recessed regions of the first ground layer in the xy plane. Accordingly, the antenna apparatus and the antenna module according to an embodiment may have a reduced size, while ensuring antenna performance (e.g., gain, bandwidth, etc.). This, however, may vary depending on design conditions.

Figure 7:
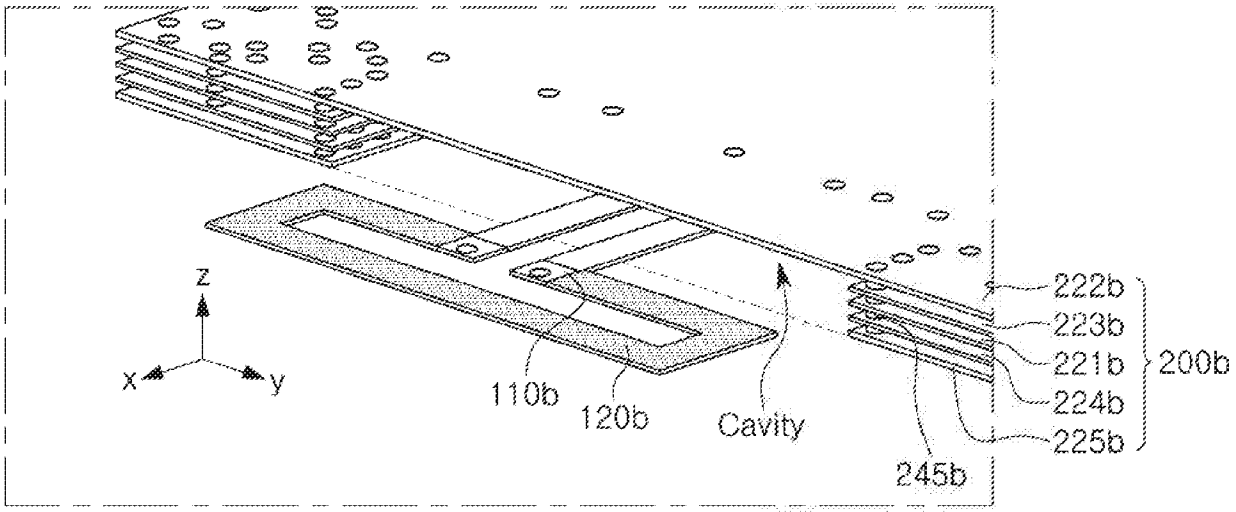
FIG. 7 is a perspective view illustrating an antenna module, according to an embodiment.
Figure 8:
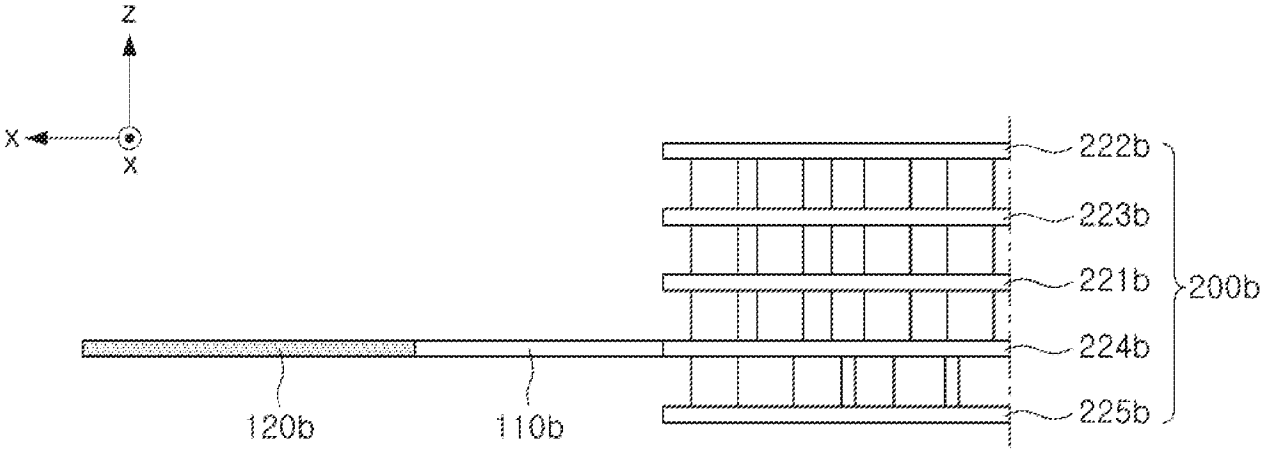
FIG. 8 is a side view illustrating the antenna module of FIG. 7.

FIG. 7 is a perspective view illustrating an antenna module, according to an embodiment. FIG. 8 is a side view illustrating the antenna module of FIG. 7.

Referring to FIGS. 7 and 8, an antenna pattern 120*b* may have a form of a folded dipole, and the feeding via and the director pattern may be omitted.

A feed line 110*b* may be disposed at the same height as a fourth ground layer 224*b* and may be electrically connected to a first wiring surrounded by the fourth ground layer 224*b*.

A connection member 200*b* may include at least one of first, second, third, fourth, and fifth ground layers 221*b*, 222*b*, 223*b*, 224*b*, and 225*b* and shielding vias 245*b*.

A first ground layer 221*b* may be recessed in a direction in which the feed line 110*b* extends from the antenna pattern 120*b*.

Figure 9:
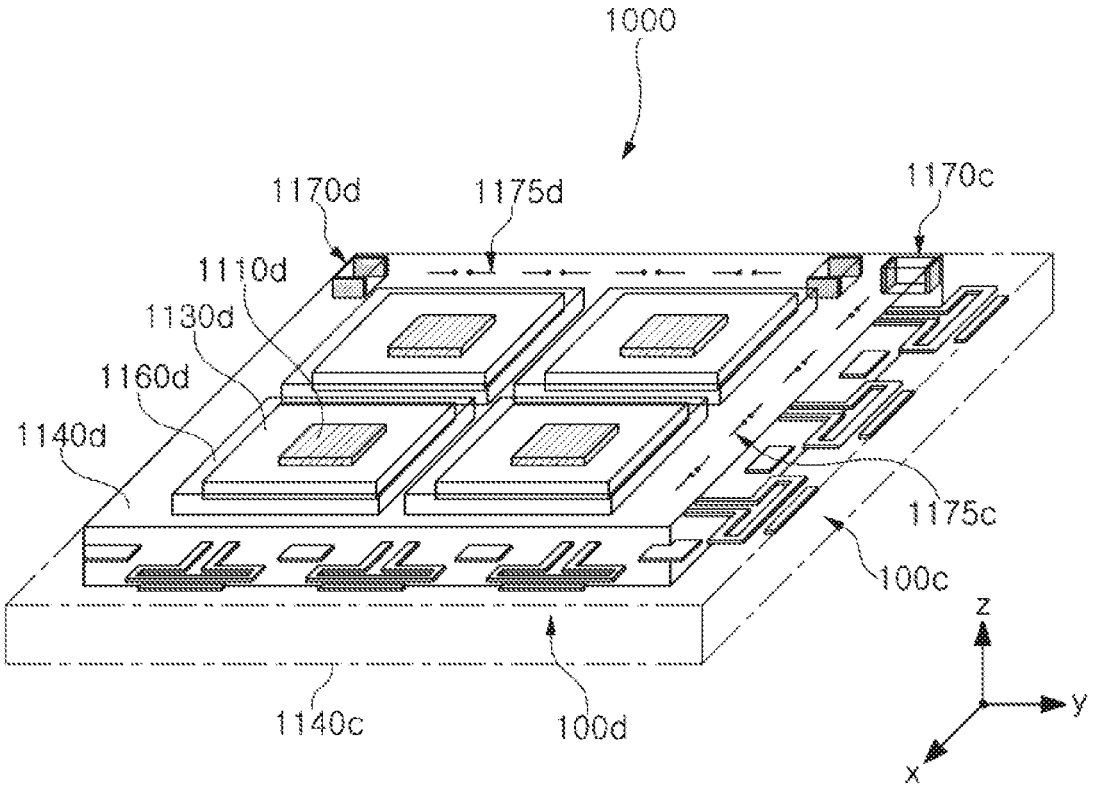
FIG. 9 is a perspective view illustrating an arrangement of antenna apparatuses included in an antenna module, according to an embodiment.

FIG. 9 is a perspective view illustrating an arrangement of antenna apparatuses 100*c* and 100*d* included in an antenna module 1000, according to an embodiment.

Referring to FIG. 9, the antenna module 1000 may include the antenna apparatuses 100*c* and 100*d*, patch antenna patterns 1110*d*, patch antenna cavities 1130*d*, dielectric layers 1140*c* and 1140*d*, a plating member 1160*d*, chip antennas 1170*c* and 1170*d*, and dipole antennas 1175*c* and 1175*d*.

The antenna apparatuses 100*c* and 100*d* may be similar to the antenna apparatuses described above with reference to FIGS. 1 through 8 and may be arranged in parallel adjacent to sides (e.g., side edges) of the antenna module 1000. Accordingly, some of the antenna apparatuses 100*c* and 100*d* may transmit and receive RF signals in the x-axis direction and others of the antenna apparatuses 100*c* and 100*d* may transmit and receive RF signals in the y-axis direction.

The ground layers described above with reference to FIGS. 1 to 8 may have a shape protruding toward the space between the antenna apparatuses 100*c* and 100*d*. For example, the ground layers may have one more protruding region than the number of the antenna apparatuses 100*c* and 100*d* or the same number of protruding regions as the number of the antenna apparatuses 100*c* and 100*d*.

The patch antenna patterns 1110*d* may be disposed adjacent to an upper side of the antenna module 1000 and may transmit and receive RF signals in the vertical direction (z direction). The number, arrangement, and shape of the patch antenna patterns 1110*d* are not limited. For example, the patch antenna patterns 1110*d* may have a circular shape and may be arranged in a structure of 1*xn* (where n is a natural number of 2 or greater), and the number of patch antenna patterns may be sixteen.

The patch antenna cavities 1130*d* may be formed to cover side surfaces and lower sides of the plurality of patch antenna patterns 1110*d*, respectively, and may provide boundary conditions for transmitting and receiving RF signals of the patch antenna patterns 1110*d*, respectively.

The chip antennas 1170*c* and 1170*d* may include two electrodes opposing each other, may be disposed on an upper side or a lower side of the antenna module, and may be disposed to transmit and receive an RF signal in the x-axis direction and/or in the y-axis direction through one of two electrodes.

The dipole antennas 1175*c* and 1175*d* may be disposed on the upper side or the lower side of the antenna module 1000, and may transmit and receive RF signals in the z axis direction. That is, the dipole antennas 1175*c* and 1175*d* may be disposed upright in the vertical direction (z direction) so as to be perpendicular to the antenna apparatuses 100*c* and 100*d*. Depending on the design, at least some of the dipole antennas 1175*c* and 1175*d* may be replaced by monopole antennas.

Figure 10A:
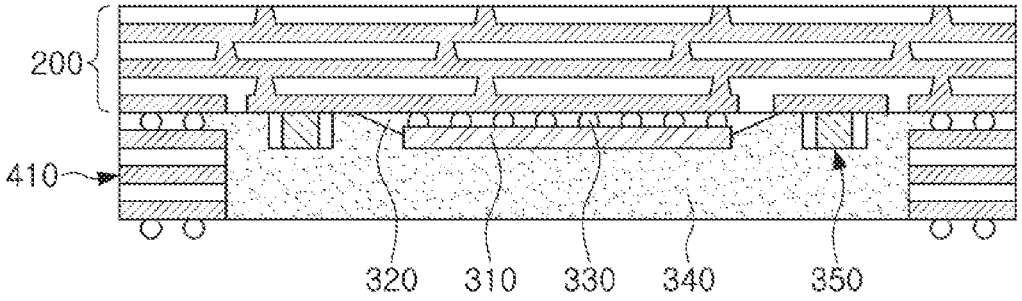
FIGS. 10A and 10B are views illustrating a lower structure of a connection member included in an antenna module, according to an embodiment.
Figure 10B:
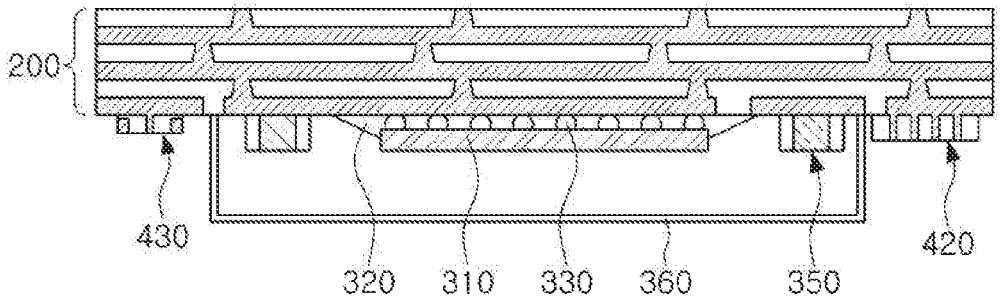

FIGS. 10A and 10B are views illustrating a lower structure of a connection member 200 of an antenna module including an antenna apparatus, according to an embodiment.

Referring to FIG. 10A, an antenna module according to an embodiment may include at least some of the connection member 200, an IC 310, an adhesive member 320, an electrical connection structure 330, an encapsulant 340, a passive component 350, and a sub-board 410.

The connection member 200 may have a structure similar to that of the connection members 200*a* and 200*b* described above with reference to FIGS. 1 through 8.

The IC 310 is the same as the IC described above, and may be disposed on a lower side of the connection member 200. The IC 310 may be electrically connected to the wiring of the connection member 200 to transmit or receive an RF signal, and may be electrically connected to the ground layer of the connection member 200 to receive a ground. For example, the IC 310 may perform at least some of frequency conversion, amplification, filtering, phase control, and power generation to produce a converted signal.

The adhesive member 320 may adhere the IC 310 and the connection member 200 to each other.

The electrical connection structure 330 may electrically connect the IC 310 and the connection member 200. For example, the electrical connection structure 330 may have a structure such as a solder ball, a pin, a land, or a pad. The electrical connection structure 330 may have a melting point lower than melting points of the wiring and the ground layer of the connection member 200, and thus, the electrical connection structure 330 may electrically connect the IC 310 and the connection member 200 through a predetermined process using the low melting point.

The encapsulant 340 may encapsulate at least a portion of the IC 310 and improve heat dissipation performance and shock protection performance of the IC 310. For example, the encapsulant 340 may be a photo imageable encapsulant (PIE), an Ajinomoto build-up film (ABF), or an epoxy molding compound (EMC).

The passive component 350 may be disposed on a lower surface of the connection member 200 and may be electrically connected to the wiring and/or the ground layer of the connection member 200 through the electrical connection structure 330.

The sub-board 410 may be disposed below the connection member 200 and may be electrically connected to the connection member 200 to receive an intermediate frequency (IF) signal or a baseband signal from the outside and transfer the received signal to the IC 310, or receive an IF signal or a baseband signal from the IC 310 and transfer the received signal to the outside. For example, a frequency (e.g., 24 GHz, 28 GHz, 36 GHz, 39 GHz, and 60 GHz) of the RF signal may be higher than a frequency (e.g., 2 GHz, 5 GHz, 10 GHz, etc.) of the IF signal.

For example, the sub-board 410 may transfer or receive an IF signal or a baseband signal to or from the IC 310 through the wiring included in an IC ground layer of the connection member 200. Since the first ground layer of the connection member 200 is disposed between the IC ground layer and the wiring, the IF signal or the baseband signal and the RF signal may be electrically isolated in the antenna module.

Referring to FIG. 10B, an antenna module according to an embodiment may include at least some of a shielding member 360, a connector 420, and a chip antenna 430.

The shielding member 360 may be disposed below the connection member 200 and confine the IC 310 together with the connection member 200. For example, the shielding member 360 may be disposed to cover the IC 310 and the passive component 350 together (e.g., conformal shield) or cover the IC 310 and passive component 350 separately (e.g., compartment shield). For example, the shielding member 360 may have a shape of hexahedron in which one side is open, and may form a hexahedral accommodation space through coupling with the connection member 200. The shielding member 360 may be formed of a material having high conductivity such as copper, may have a short skin depth, and may be electrically connected to the ground layer of the connection member 200. Accordingly, the shielding member 360 may reduce electromagnetic noise that may act on the IC 310 and the passive component 350.

The connector 420 may have a connection structure of a cable (e.g., a coaxial cable, or a flexible PCB), may be electrically connected to the IC ground layer of the connection member 200, and may have a role similar to that of the sub-board described above. That is, the connector 420 may be provided with an IF signal, a baseband signal, and/or power from a cable, or may provide an IF signal and/or a baseband signal to the cable.

The chip antenna 430 may transmit or receive an RF signal to assist the antenna apparatus according to an embodiment. For example, the chip antenna 430 may include a dielectric block having permittivity higher than that of the insulating layer and electrodes disposed on both sides of the dielectric block. One of the electrodes may be electrically connected to the wiring of the connection member 200 and the other of the electrodes may be electrically connected to the ground layer of the connection member 200.

Figure 11:
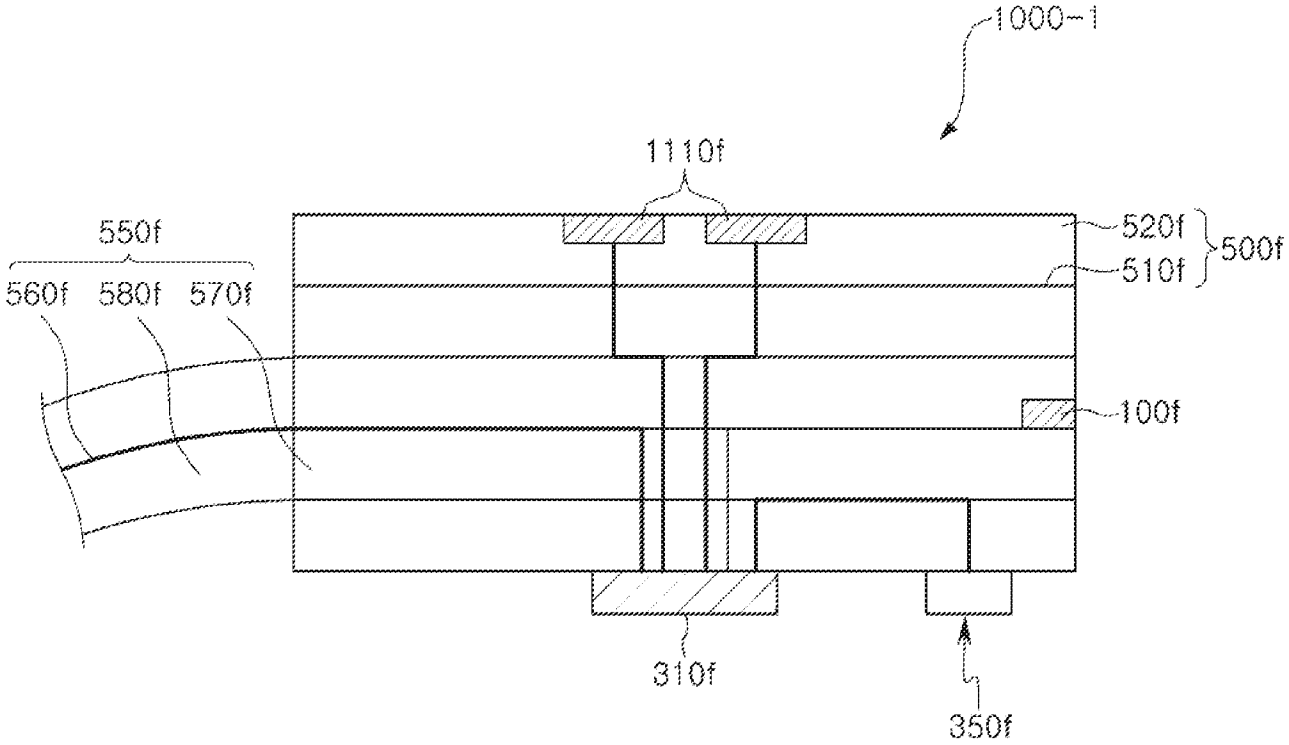
FIG. 11 is a side view illustrating a schematic structure of an antenna module, according to an embodiment.

FIG. 11 is a side view illustrating a schematic structure of an antenna module 1000-1 including an antenna apparatus 100*f*, according to an embodiment.

Referring to FIG. 11, an antenna module 1000-1 may include an antenna apparatus 100*f*, a patch antenna pattern 1110*f*, an IC 310*f*, and a passive component 350*f* integrated in a connection member 500*f*.

The antenna apparatus 100*f* and the patch antenna pattern 1110*f* may be designed to be the same as the antenna apparatus 100*c*/100*d* and the patch antenna pattern 1110*d* described above, and may receive an RF signal from the IC 310*f* and transmit the received RF signal, or transfer a received RF signal to the IC 310*f*.

The connection member 500*f* may have a structure in which at least one conductive layer 510*f* and at least one insulating layer 520*f* are stacked (e.g., a structure of a printed circuit board (PCB)). The conductive layer 510*f* may include the ground layer and the wiring described above.

Furthermore, the antenna module 1000-1 may further include a flexible connection member 550*f*. The flexible connection member 550*f* may include a first flexible region 570*f* overlapping the connection member 500*f* and a second flexible region 580*f* not overlapping the connection member 500*f*, when viewed in the vertical direction. That is, the first flexible region 570*f* may overlap the connection member 500*f* in the xy plane, and the second flexible region 580*f* may not overlap the connection member 500*f* in the xy plane.

The second flexible region 580*f* may be bent flexibly in the vertical direction. Accordingly, the second flexible region 580*f* may be flexibly connected to a connector and/or an adjacent antenna module of a set board.

The flexible connection member 550*f* may include a signal line 560*f*. An intermediate frequency (IF) signal and/or baseband signal may be transferred to the IC 310*f* via the signal line 560*f* or to the connector and/or the adjacent antenna module of the set board.

Figure 12A:
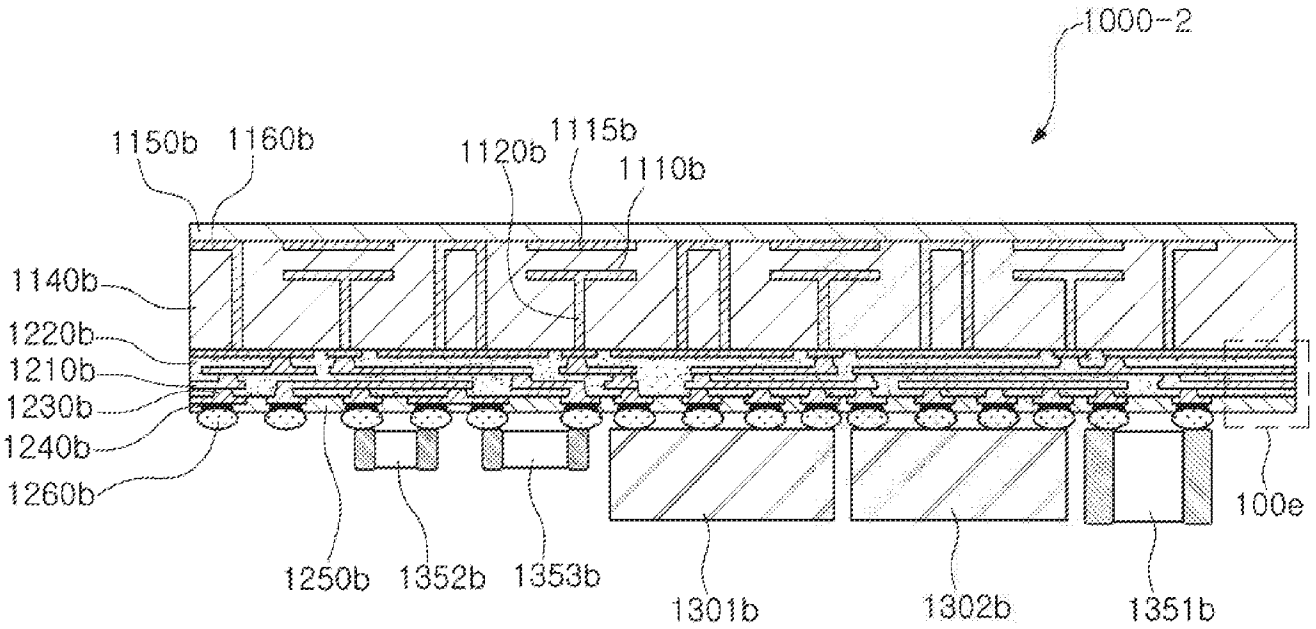
FIGS. 12A and 12B are side views illustrating various structures of an antenna module, according to an embodiment.
Figure 12B:
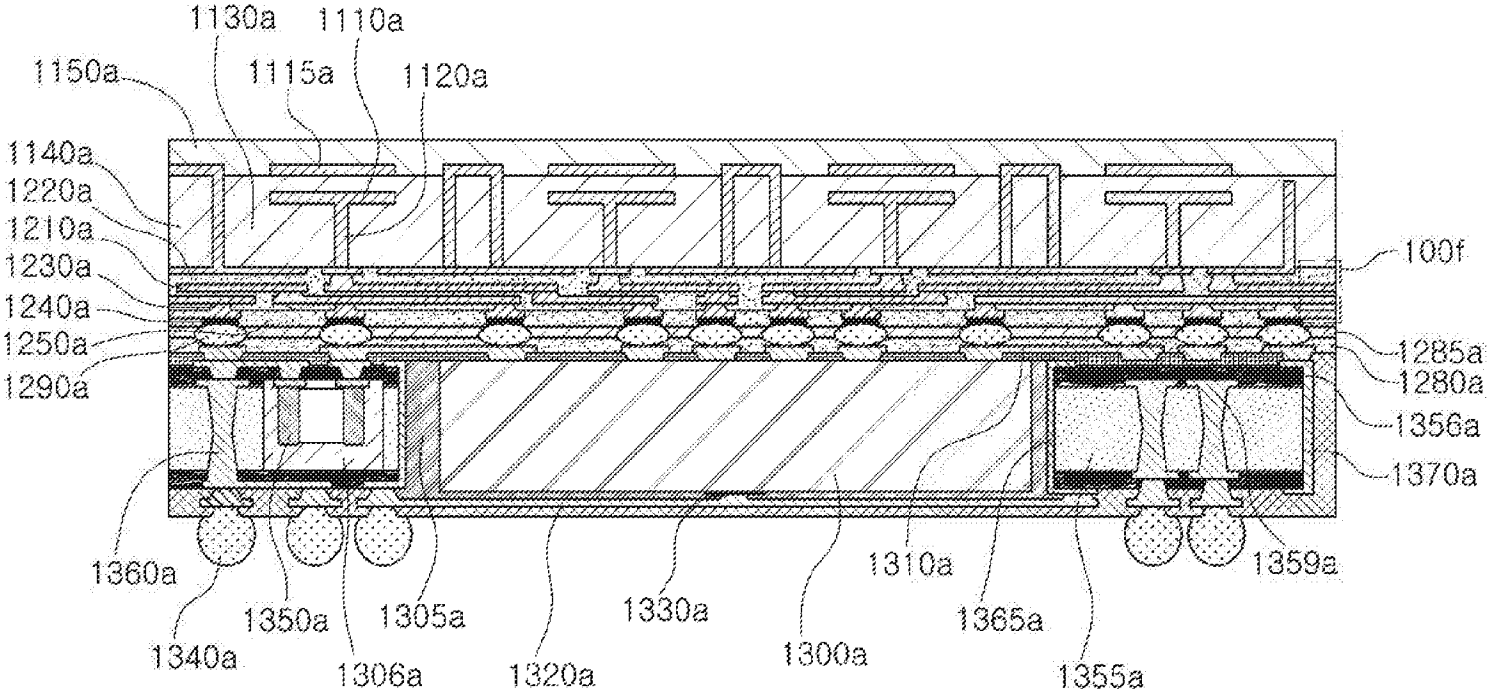

FIGS. 12A and 12B are side views illustrating various structures of an antenna module 1000-2 including an antenna apparatus according to an embodiment.

Referring to FIG. 12A, the antenna module 1000-2 may have a structure in which an antenna package and a connection member are combined. The antenna module 1000-2 may include the antenna apparatus 100*e*.

The connection member may include at least one conductive layer 1210*b* and at least one insulating layer 1220*b*, may include a wiring via 1230*b* connected to the at least one conductive layer 1210*b* and a connection pad 1240*b* connected to the wiring via 1230*b*, and may have a structure similar to that of a copper redistribution layer (RDL). An antenna package may be disposed on an upper surface of the connection member.

The antenna package may include at least some of patch antenna patterns 1110*b*, upper coupling patterns 1115*b*, patch antenna feeding vias 1120*b*, a dielectric layer 1140*b*, and an encapsulation member 1150*b*.

First ends of the patch antenna feeding vias 1120*b* may be electrically connected to the patch antenna patterns 1110*b*, respectively, and the second ends of the patch antenna feeding vias 1120*b* may each be electrically connected to a wiring corresponding to at least one conductive layer 1210*b* of the connection member.

The dielectric layer 1140*b* may be disposed to encompass a side surface of each of the feeding vias 1120*b*. The dielectric layer 1140*b* may have a height greater than a height of the at least one insulating layer 1220*b* of the connection member. In the antenna package, a greater height and/or width of the dielectric layer 1140*b* may be more advantageous in terms of ensuring antenna performance, and may provide boundary conditions (e.g., small manufacturing tolerance, a short electrical length, a smooth surface, a large size of a dielectric layer, dielectric constant control, etc.) advantageous for an RF signal transmission/reception operation of the antenna patterns 1115*b*.

The encapsulation member 1150*b* may be disposed on the dielectric layer 1140*b* and may enhance durability with respect to an impact or oxidation of the plurality of patch antenna patterns 1110*b* and/or the plurality of upper coupling patterns 1115*b*. For example, the encapsulation member 1150*b* may be implemented as a photo imageable encapsulant (PIE), an Ajinomoto build-up film (ABF), or an epoxy molding compound (EMC), but is not limited thereto.

An IC 1301*b*, a PMIC 1302*b*, and passive components 1351*b*, 1352*b*, and 1353*b* may be disposed on a lower surface of the connection member.

The PMIC 1302*b* may generate power and deliver the generated power to the IC 1301*b* through at least one conductive layer 1210*b* of the connection member.

The passive components 1351*b*, 1352*b*, and 1353*b* may provide impedance to the IC 1301*b* and/or the PMIC 1302*b*. For example, passive components 1351*b*, 1352*b*, and 1353*b* may include at least some of a capacitor (e.g., a multilayer ceramic capacitor (MLCC)), an inductor, and a chip resistor.

Referring to FIG. 12B, the IC package may include an IC 1300*a*, an encapsulant 1305*a* encapsulating at least a portion of the IC 1300*a*, a support member 1355*a* disposed such that a first side surface thereof faces the IC 1300*a*, and a connection member including at least one conductive layer 1310*a* and an insulating layer 1280*a* electrically connected to the IC 1300*a* and the support member 1355*a*, and may be coupled to a connection member or an antenna package.

The connection member may include at least one conductive layer 1210*a*, at least one insulating layer 1220*a*, a wiring via 1230*a*, a connection pad 1240*a*, and a passivation layer 1250*a*. The antenna package may include patch antenna patterns 1110*a*, 1110*b*, 1110*c* and 1110*d*, upper coupling patterns 1115*a*, 1115*b*, 1115*c* and 1115*d*, patch antenna feeding vias 1120*a*, 1120*b*, 1120*c*, and 1120*d*, a dielectric layer 1140*a*, and an encapsulation member 1150*a*.

The IC package may be coupled to the connection member described above. An RF signal generated in the IC 1300*a* included in the IC package may be transferred to the antenna package through the at least one conductive layer 1310*a* and transmitted in a direction toward an upper surface of the antenna module, and an RF signal received by the antenna package may be transferred to the IC 1300*a* through the at least one conductive layer 1310*a*.

The IC package may further include a connection pad 1330*a* disposed on an upper surface and/or a lower surface of the IC 1300*a*. The connection pad disposed on the upper surface of the IC 1300*a* may be electrically connected to the at least one conductive layer 1310*a* and the connection pad disposed on the lower surface of the IC 1300*a* may be connected to the support member 1355*a* or a core plating member 1365*a* through a lower conductive layer 1320*a*. The core plating member 1365*a* may provide a grounding region to the IC 1300*a*.

The support member 1355*a* may include a core dielectric layer 1356*a* in contact with the connection member, a core conductive layer 1359*a* disposed on an upper surface and/or a lower surface of the core dielectric layer 1356*a*, and at least one core via 1360*a* penetrating through the core dielectric layer 1356*a*, electrically connecting the core conductive layer 1359*a*, and electrically connected to the connection pad 1330*a*. The at least one core via 1360*a* may be electrically connected to an electrical connection structure 1340*a* such as a solder ball, a pin, or a land.

Accordingly, the support member 1355*a* may receive a base signal or power from the lower surface thereof and transfer the base signal and/or power to the IC 1300*a* through the at least one conductive layer 1310*a* of the connection member.

The IC 1300*a* may generate an RF signal of a millimeter wave (mmWave) band using the base signal and/or power. For example, the IC 1300*a* may receive a base signal of a low frequency and perform frequency conversion, amplification, filtering, and phase control on the base signal, and power generation. The IC 1300*a* may be formed of a compound semiconductor (e.g., GaAs) or a silicon semiconductor in consideration of high frequency characteristics.

The IC package may further include a passive component 1350*a* electrically connected to a corresponding wiring of at least one conductive layer 1310*a*. The passive component 1350*a* may be disposed in an accommodation space 1306*a* provided by the support member 1355*a*.

The IC package may include core plating members 1365*a* and 1370*a* disposed on a side surface of the support member 1355*a*. The core plating members 1365*a* and 1370*a* may provide a ground region to the IC 1300*a* and may dissipate heat from the IC 1300*a* to the outside or cancel noise with respect to the IC 1300*a*.

The IC package and the connection member may be independently manufactured and coupled to each other or may be manufactured together according to design. That is, a separate process of coupling packages may be omitted.

The IC package may be coupled to the connection member through an electrical connection structure 1290*a* and a passivation layer 1285*a*, but the electrical connection structure 1290*a* and the passivation layer 1285*a* may be omitted according to designs.

Figure 13A:
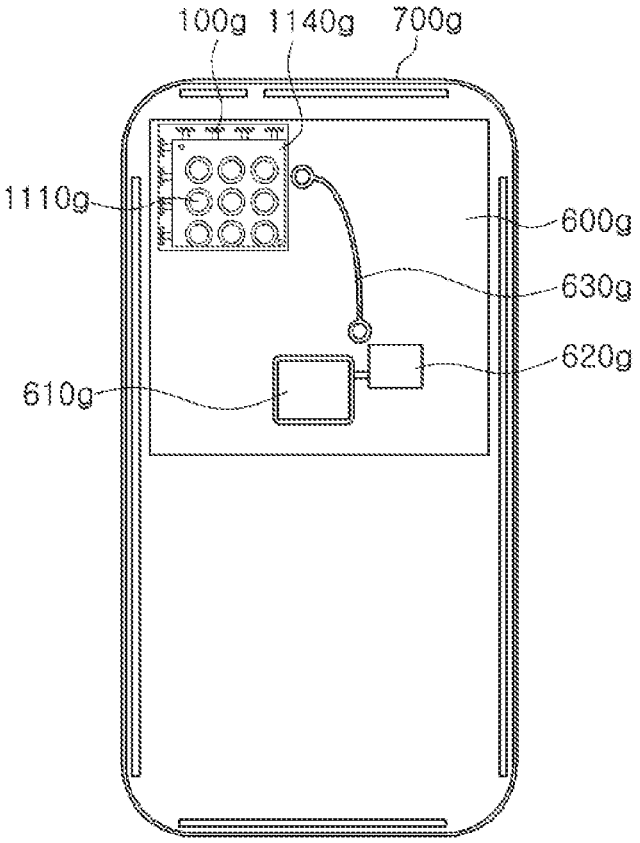
FIGS. 13A and 13B are plan views illustrating arrangements of antenna modules in electronic devices, according to an embodiment.
Figure 13B:
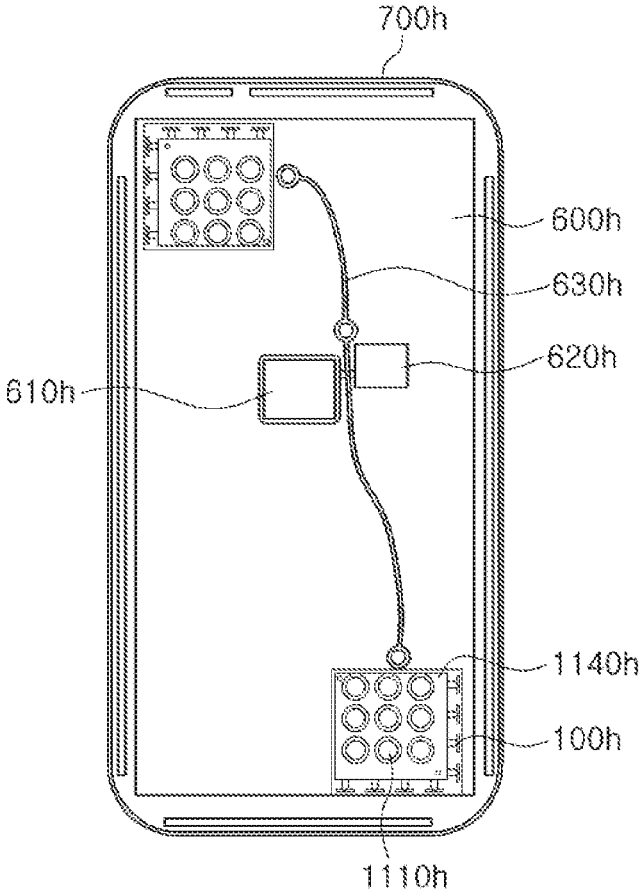

FIGS. 13A and 13B are plan views illustrating an arrangement of antenna modules in electronic devices 700*g* and 700*h*, according to an embodiment.

Referring to FIG. 13A, an antenna module including an antenna apparatus 100*g*, a patch antenna pattern 1110*g*, and a dielectric layer 1140*g* may be mounted adjacent to a side boundary of an electronic device 700*g* on a set board 600*g* of the electronic device 700*g*.

The electronic device 700*g* may be a smartphone, a personal digital assistant, a digital video camera, a digital still camera, a network system, a computer, a monitor, a tablet, a laptop, a netbook, a television, a video game, a smart watch, or an automotive system, but is not limited to the foregoing examples.

A communications module 610*g* and a baseband circuit 620*g* may be further disposed on the set board 600*g*. The antenna module may be electrically coupled to the communications module 610*g* and/or the baseband circuit 620*g* via a coaxial cable 630*g*.

The communications module 610*g* may include at least some of a memory chip such as a volatile memory (e.g., DRAM), a non-volatile memory (e.g., ROM), a flash memory, etc., to perform digital signal processing; an application processor chip, such as a central processor (e.g., CPU), a graphics processor (e.g., GPU), a digital signal processor, an encryption processor, a microprocessor, or a micro-controller, and the like; and a logic chip such as an analog-to-digital converter (ADC), an application-specific IC (ASIC), and the like.

The baseband circuit 620*g* may perform analog-to-digital conversion and amplification, filtering, and frequency conversion on an analog signal to generate a base signal. The base signal input/output from the baseband circuit 620*g* may be transferred to the antenna module via a cable.

For example, the base signal may be transferred to the IC through an electrical connection structure, a core via, and a wiring. The IC may convert the base signal into an RF signal of a millimeter wave (mmWave) band.

Referring to FIG. 13B, antenna modules each including an antenna apparatus 100*h*, a patch antenna pattern 1110*h* and a dielectric layer 1140*h* are mounted adjacent to one boundary and the other boundary of an electronic device 700*h* on a set board 600*h* of the electronic device 700*h*, and a communications module 610*h* and a baseband circuit 620*h* may be further disposed on the set board 600*h*. The antenna modules may be electrically connected to the communications module 610*h* and/or the baseband circuit 620*h* via a coaxial cable 630*h*.

The conductive layer, the ground layer, the feed line, the feeding via, the antenna pattern, the patch antenna pattern, the shielding via, the director pattern, the electrical connection structure, the plating member, and the core via described in this disclosure may include a metal (e.g., a conductive material such as copper (Cu), aluminum (Al), silver (Ag), tin (Sn), gold (Au), nickel (Ni), lead (Pb), titanium (Ti), or an alloy thereof) and may be formed through a plating method such as chemical vapor deposition (CVD), physical vapor deposition (PVD), sputtering, subtractive, additive, semi-additive process (SAP), a modified semi-additive process (MSAP), and the like, but is not limited to the foregoing examples.

The dielectric layer and/or the insulating layer described in this disclosure may be formed of a thermosetting resin such as FR4, liquid crystal polymer (LCP), low temperature co-fired ceramic (LTCC), a resin such as a thermoplastic resin such as an epoxy resin, a thermoplastic resin such as polyimide, a resin obtained by impregnating these resins in a core of glass fiber, glass cloth, glass fabric, and the like, together with an inorganic filler, prepreg, Ajinomoto build-up film (ABF), FR-4, bismaleimide triazine (BT), photo imageable dielectric (PID) resin, general copper clad laminate (CCL), or glass or ceramic-based insulator. The insulating layer may fill at least a portion of a position where a conductive layer, a ground layer, a feed line, a feeding via, an antenna pattern, a patch antenna pattern, a shield via, a director pattern, an electrical connection structure, a plating member, or a core via is not disposed in the antenna apparatus and the antenna module disclosed in this disclosure.

The RF signals described in this disclosure may have a form such as Wi-Fi (IEEE 802.11 family, etc.), WiMAX (IEEE 802.16 family, etc.), IEEE 802.20, long term evolution (LTE), Ev-DO, HSPA+, HSDPA+, HSUPA+, EDGE, GSM, GPS, GPRS, CDMA, TDMA, DECT, Bluetooth, 3G, 4G, 5G and a following one in accordance with certain designated wireless and wired protocols, but is not limited to such examples.

As set forth above, the antenna module and/or antenna apparatus according to embodiments disclosed herein may have a structure advantageous for miniaturization, while improving antenna performance (e.g., transmission/reception ratio, gain, bandwidth, directivity, etc.).

The antenna module and/or the antenna apparatus according to an embodiment may maintain antenna performance, while having a reduced size by arranging the antenna pattern in a more compressed manner, improve the degree of freedom of a reflector of the antenna pattern to have more precisely adjusted antenna performance, and improve isolation between antenna apparatuses.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

a first ground layer;

a second ground layer disposed on a surface of the first ground layer;

an antenna pattern spaced apart from the first and second ground layers in a first direction of the surface, and configured to transmit and/or receive a radio frequency (RF) signal; and a feed line electrically connected to the antenna pattern and extending from the antenna pattern toward the first ground layer in the first direction of the surface, wherein the first ground layer comprises a first recess extending rearward, relative to the second ground layer, in the first direction of the surface, and wherein the antenna pattern is entirely forwardly spaced apart from a front boundary of the first recess in the first direction of the surface such that a rear edge of the antenna pattern is forwardly spaced apart from the front boundary of the first recess, in the first direction of the surface, by a first distance, and a total length of the antenna pattern is shorter than a length of the first recess in a second direction of the surface perpendicular to the first direction of the surface, and wherein a second distance between the front boundary of the first recess and a rear boundary of the first recess in the first direction of the surface is greater than the first distance.

2. The antenna apparatus of claim 1, further comprising:

a feeding via disposed to electrically connect the antenna pattern and the feed line, wherein the antenna pattern is spaced away from the second ground layer by the feeding via.

3. The antenna apparatus of claim 1, further comprising:

shielding vias electrically connected to the second ground layer and arranged along a boundary of the first recess.

4. The antenna apparatus of claim 1, further comprising:

a wiring electrically connected to the feed line; and a third ground layer disposed to surround the wiring, wherein the third ground layer comprises a second recess extending rearward, relative to the second ground layer, in the first direction of the surface.

5. The antenna apparatus of claim 4, further comprising:

a wiring via electrically connected to the wiring; and a fourth ground layer having a through hole through which the wiring via passes, wherein the fourth ground layer comprises a third recess extending rearward, relative to the second ground layer, in the first direction of the surface.

6. The antenna apparatus of claim 5, wherein the first, second, and third recesses have a same rectangular shape.

7. The antenna apparatus of claim 1, wherein the antenna pattern has a form of a dipole.

8. The antenna apparatus of claim 1, wherein a closest distance between the antenna pattern and a side of the second ground layer in the first direction of the surface is shorter than a recessed length of the first recess.

9. The antenna apparatus of claim 8, further comprising:

a director pattern spaced apart from the antenna pattern, wherein a distance between the director pattern and the second ground layer in the first direction of the surface is greater than the recessed length of the first recess.

10. An antenna apparatus, comprising:

a connection member comprising a first ground layer and a second ground layer spaced from the first ground layer in a vertical direction;

an antenna pattern spaced from the first and second ground layers in a forward horizontal direction, and configured to transmit and/or receive a radio frequency (RF) signal; and a feed line electrically connected to the antenna pattern and extending from the antenna pattern toward the first ground layer, wherein the first ground layer comprises a first recessed portion that is recessed from an end portion of the second ground layer in a rearward horizontal direction, wherein a cavity is formed by the second ground layer and the first recessed portion, and wherein a total length of the antenna pattern is shorter than a length of the first recessed portion in a lateral direction perpendicular to the forward and rearward horizontal directions, and wherein the antenna pattern is entirely spaced apart from a front boundary of the cavity in the forward horizontal direction such that a rear edge of the antenna pattern is spaced apart from the front boundary of the cavity in the forward horizontal direction by a first distance, and wherein a second distance between the front boundary of the cavity and a rear boundary of the cavity in the forward and rearward horizontal directions is greater than the first distance.

11. The antenna apparatus of claim 10, further comprising:

a third ground layer spaced from the first ground layer and the second ground layer in the vertical direction, and comprising a second recessed portion that is recessed from the end portion of the second ground layer in the rearward horizontal direction, wherein the cavity is further formed by the third ground layer.

12. The antenna apparatus of claim 10, wherein the first ground layer further comprises side-end portions that protrude from the first recessed portion in the forward horizontal direction and form side boundaries of the cavity.

13. An antenna apparatus, comprising:

a first ground layer comprising a recess;

a second ground layer comprising a surface disposed on the first ground layer and a side at an edge of the surface, wherein a portion of the surface is exposed by the recess;

a feed line extending forward from the first and second ground layers, beyond the side, in a first direction parallel to the surface; and an antenna pattern electrically connected to the feed line and configured to transmit and/or receive a radio frequency (RF) signal, wherein the antenna pattern is entirely forwardly spaced apart from the side and a front boundary of the recess in the first direction parallel to the surface, such that the antenna pattern opposes the recess and a rear edge of the antenna pattern is forwardly spaced apart from the front boundary of the first recess, in the first direction parallel to the surface, by a first distance, wherein a total length of the antenna pattern is shorter than a length of the recess in a second direction parallel to the surface, the second direction parallel to the surface being perpendicular to the first direction parallel to the surface, and wherein a second distance between the front boundary of the recess and a rear boundary of the recess in the first direction parallel to the surface is greater than the first distance.

14. The antenna apparatus of claim 13, further comprising:

a feeding via disposed to electrically connect the antenna pattern and the feed line, wherein the antenna pattern is spaced away from the surface in a direction perpendicular to the surface by the feeding via.

15. The antenna apparatus of claim 13, further comprising a third ground layer disposed on the first ground layer, wherein the third ground layer comprises a second recess exposing the portion of the surface.

* * * * *